US011274446B2

(12) United States Patent
Wakiyama et al.

(10) Patent No.: US 11,274,446 B2
(45) Date of Patent: Mar. 15, 2022

(54) SCREW-TYPE REBAR JOINT STRUCTURE OF DEFORMED REBAR AND MANUFACTURING METHOD THEREOF

(71) Applicant: Akira Fukuda, Osaka (JP)

(72) Inventors: Kozo Wakiyama, Osaka (JP); Keiji Hirai, Fukuoka (JP); Akira Fukuda, Osaka (JP)

(73) Assignee: Akira Fukuda

( * ) Notice: Subject to any disclaimer, the term of this patent is extended or adjusted under 35 U.S.C. 154(b) by 419 days.

(21) Appl. No.: 16/279,390

(22) Filed: Feb. 19, 2019

(65) Prior Publication Data

US 2019/0177976 A1 Jun. 13, 2019

Related U.S. Application Data

(63) Continuation of application No. PCT/JP2017/036830, filed on Oct. 11, 2017.

(30) Foreign Application Priority Data

Oct. 13, 2016 (JP) ..... JP2016-201748
Sep. 15, 2017 (JP) ..... JP2017-177804
Sep. 28, 2017 (JP) ..... JP2017-188827

(51) Int. Cl.
*E04C 5/16* (2006.01)
*E04C 5/03* (2006.01)
(Continued)

(52) U.S. Cl.
CPC ..... *E04C 5/01* (2013.01); *B21F 15/06* (2013.01); *B21H 3/02* (2013.01); *E04C 5/03* (2013.01); *E04C 5/162* (2013.01); *E04C 5/165* (2013.01)

(58) Field of Classification Search
CPC ... E04C 5/01; E04C 5/03; E04C 5/165; E04C 5/162; B21H 3/02; B21F 15/06; B21F 1/02
(Continued)

(56) References Cited

U.S. PATENT DOCUMENTS 1,326,008 A * 12/1919 Tarbox ..... F16C 11/0647 403/27
1,415,658 A * 5/1922 Lane ..... E21B 17/046 403/27
(Continued)

FOREIGN PATENT DOCUMENTS

CN 1239172 12/1999
CN 1251635 4/2000
(Continued)

OTHER PUBLICATIONS

International Preliminary Report on Patentability for corresponding International PCT Patent Application No. PCT/JP2017/036830, dated Apr. 25, 2019 (6 pages).
(Continued)

*Primary Examiner* — Brent W Herring

(57) ABSTRACT

A threaded reinforcing bar coupling structure comprises a pair of reinforcing bars and a tubular coupler connecting the pair of reinforcing bars. Each of the reinforcing bars is a deformed reinforcing bar having spiral node portions on an outer periphery of a reinforcing bar main body having a round shaft shape. A cylindrical portion with node portions removed is formed on an end portion of the reinforcing bar, and a male threaded portion is formed on the cylindrical portion. The male threaded portion has hardness or tensile strength greater than that of a remaining portion of the
(Continued)

reinforcing bar. The pair of reinforcing bars is connected by the screw tubular coupler that is screwed onto the male threaded portions.

8 Claims, 31 Drawing Sheets

(51) Int. Cl.
*E04C 5/01* (2006.01)
*B21H 3/02* (2006.01)
*B21F 15/06* (2006.01)

(58) Field of Classification Search
USPC ..... 52/583.1, 848, 849, 851, 852, 853
See application file for complete search history.

(56) References Cited

U.S. PATENT DOCUMENTS

| | | | | | |
|---|---|---|---|---|---|
| 2,679,414 | A * | 5/1954 | Hornschuch | F16D 1/02 | 403/307 |
| 4,953,379 | A | 9/1990 | Richartz | | |
| 5,746,555 | A * | 5/1998 | McEvoy | E04C 5/165 | 403/307 |
| 5,967,691 | A * | 10/1999 | Lancelot, III | E04C 5/165 | 403/296 |
| 6,328,499 | B1 | 12/2001 | Reding et al. | | |
| 2014/0010590 | A1* | 1/2014 | Stewart | C21D 9/0075 | 403/345 |
| 2015/0037090 | A1 | 2/2015 | Fukuda | | |

FOREIGN PATENT DOCUMENTS

| | | | | | |
|---|---|---|---|---|---|
| CN | 101614307 | B * | 10/2012 | B21H 3/02 | |
| EP | 0867578 | A1 * | 9/1998 | F16B 7/182 | |
| EP | 0947642 | A2 | 10/1999 | | |
| JP | 48-025640 | | 7/1973 | | |
| JP | 59-113948 | | 6/1984 | | |
| JP | 01-148433 | | 6/1989 | | |
| JP | 10-037386 | | 2/1998 | | |
| JP | 2003-278316 | | 10/2003 | | |
| JP | 4025851 | | 10/2007 | | |
| JP | 2008-264798 | | 11/2008 | | |
| JP | 2011-084897 | | 4/2011 | | |
| JP | 2011-102488 | | 5/2011 | | |
| JP | 5869716 | | 1/2016 | | |
| JP | 2016-108926 | | 2/2016 | | |
| JP | 2016108926 | A * | 6/2016 | E04C 5/18 | |
| KR | 10-0316435 | | 10/1999 | | |
| KR | 200186303 | Y1 * | 6/2000 | | |
| KR | 101456825 | B1 * | 10/2014 | E04C 5/01 | |
| KR | 10-2015-0006751 | | 1/2015 | | |
| TW | 201445035 | | 12/2014 | | |
| WO | WO98/44215 | | 10/1998 | | |
| WO | 0123118 | A1 | 4/2001 | | |
| WO | WO-0123118 | A1 * | 4/2001 | B21J 5/08 | |
| WO | WO-2005061814 | A1 * | 7/2005 | E04C 5/165 | |
| WO | WO-2012131579 | A1 * | 10/2012 | E04C 5/03 | |
| WO | WO2013/157531 | | 4/2013 | | |
| WO | WO-2013157531 | A1 * | 10/2013 | F16B 7/182 | |
| WO | WO2016/092999 | | 6/2016 | | |
| WO | WO-2018070429 | A1 * | 4/2018 | B21H 3/02 | |
| WO | WO-2019194189 | A1 * | 10/2019 | E04G 21/12 | |

OTHER PUBLICATIONS

Extended European Search Report on corresponriding EP 17860388, dated Apr. 21, 2020.

Office Action dated Jun. 12, 2019 for Corresponding Taiwan Patent Application No. 106135096 with English Language Translation (17 pages).

Chinese Patent Office, Office Action for corresponding Chinese Application No. 201780050050.2 & its English machine translation, dated Jul. 13, 2021, 10 pages.

Notification of Reason of Refusal for corresponding Korean Patent Application No. 10-2019-7004262 & its English machine translation, dated Nov. 29, 2021, 18 pages.

* cited by examiner

SCREW-TYPE REBAR JOINT STRUCTURE OF DEFORMED REBAR AND MANUFACTURING METHOD THEREOF

CROSS REFERENCE TO THE RELATED APPLICATION

This application is a continuation application, under 35 U.S.C. § 111(a) of international patent application No. PCT/JP2017/036830, filed Oct. 11, 2017, which claims priority to Japanese patent applications No. 2016-201748, filed Oct. 13, 2016, No. 2017-177804, filed Sep. 15, 2017, and No. 2017-188827, filed Sep. 28, 2017, the entire disclosure of which are incorporated by reference as a part of this application.

BACKGROUND OF THE INVENTION

Field of the Invention

The present invention relates to a threaded reinforcing bar coupling structure for a deformed reinforcing bar for use in reinforced concrete, and a method for manufacturing the same.

Description of Related Art

In reinforced concrete, deformed reinforcing bars are generally used as reinforcing bars because of their excellent anchorage performance. Reinforcing bar couplings for connecting deformed reinforcing bars include various type of a reinforcing bar coupling, such as a lap coupling, and a threaded reinforcing bar coupling is used in order to simplify bar arrangement structure and/or to shorten construction periods. In a threaded reinforcing bar coupling, if a male threaded portion is formed on a reinforcing bar by cutting, it causes decrease in proof stress or strength due to partial loss of cross-section. Thus, it has been proposed to provide the reinforcing bar with a large diameter portion and to roll a male thread on the large diameter portion (e.g. Patent Document 1). In this proposed example, it is also suggested to provide a lock nut to prevent backlash.

PRIOR ART DOCUMENT

[Patent Document 1] Japanese Patent No. 5,869,716

The reinforcing bar coupling proposed by Patent Document 1 is advantageous in that a male threaded portion has excellent proof stress since the male thread is formed on a large diameter portion provided on the reinforcing bar. However, this requires formation of the large diameter portion and results in increase in manufacturing costs. Such increase in manufacturing costs can be suppressed to some extent by simultaneously forming the large diameter portion on the reinforcing bar raw material when nodes and ribs of the deformed reinforcing bar are formed by roll forming, but is not sufficiently suppressed. In addition, roll forming forms large diameter portions of the reinforcing bar with a constant pitch according to a roll diameter, but causes some errors in the pitch. Therefore, each time a large diameter portion of a reinforcing bar end portion to be cut at the center of the large diameter portion in a length direction thereof to obtain a pair of male threaded portion is obtained, adjustment of position is required, resulting in lower productivity in mass production.

SUMMARY OF THE INVENTION

An object of the present invention is to provide a threaded reinforcing bar coupling structure for a deformed reinforcing bar, which is excellent in productivity, does not have a practical problem of decrease in proof stress due to processing of a male threaded portion, and is capable of providing required proof stress; and a method for manufacturing thereof.

The threaded reinforcing bar coupling structure of the present invention comprises a pair of reinforcing bars and a screw tubular coupler connecting the pair of reinforcing bars with each other, wherein at least one reinforcing bar of the pair of reinforcing bars is a deformed reinforcing bar including a reinforcing bar main body having a round shaft shape and a plurality of annular node portions or spiral node portions on an outer periphery of the reinforcing bar main body; each reinforcing bar has opposite end portions, at least one of the opposite end portions having a cylindrical portion with the node portions removed, the cylindrical portion being formed with a male threaded portion; the male threaded portion has a thread ridge diameter larger than that of the reinforcing bar main body and a thread groove diameter smaller than that of the reinforcing bar main body; the male threaded portion has hardness or tensile strength greater than that of a remaining portion of the reinforcing bar; and the coupler is screwed onto the male threaded portions of the pair of reinforcing bars.

According to this configuration, the pair of reinforcing bars can be connected by screwing the male threaded portions of both reinforcing bars into the coupler, and thus, it is possible to simplify bar arrangement and/or to shorten construction periods in a similar way to common reinforcing bar couplings. Each of the male threaded portions has a thread groove diameter smaller than that of the reinforcing bar main body and a thread ridge diameter larger than that of the reinforcing bar main body. Therefore, it is possible to form a male threaded portion on a deformed reinforcing bar as a raw material without any preprocessing or only with some preprocessing, such as perfect circle processing. Thus, the male threaded portion can be formed by performing thread forming to the deformed reinforcing bar without performing large scale preprocessing, such as diameter enlargement, resulting in excellent in productivity.

Decrease in proof stress such as tensile strength of the reinforcing bar in the coupling portion may be concerned, since the thread groove diameter of the male threaded portion is smaller than that of the reinforcing bar main body. However, according to the construction, since hardness of the male threaded portion is greater than that of the remaining portion, the decrease in proof stress can be compensated, and therefore, sufficient proof stress can be achieved. Hardness required for compensating the decrease in proof stress due to groove processing of the male threaded portion can be sufficiently obtained from work hardening (also called as plastic hardening) by rolling the male threaded portion. Therefore, hardness required for the male threaded portion can also be obtained by simply rolling the male threaded portion on the deformed reinforcing bar. Accordingly, a dedicated process for enhancing hardness of the male threaded portion is not required, which also contributes to excellent productivity. If couplers are prepared, work that is left is merely to cut deformed reinforcing bars and to roll male threaded portions, and thus can be performed at a construction site.

In the threaded reinforcing bar coupling structure of the present invention, the reinforcing bar may be a deformed reinforcing bar having the spiral node portions.

As a deformed reinforcing bar, a screw node reinforcing bar on which surface nodes are formed in a screw shape is known. The screw node reinforcing bar can be cut at any position on construction site, and the reinforcing bars can be coupled using a coupler or a lock nut. However, in the screw node reinforcing bar, screw nodes have a large screw pitch since such screw nodes are formed by pressure rolling. Therefore, couplers having a longer length are required. In addition, contact surfaces of the screws are rendered to be course. Such reduce adhesion and require use of a lock nut and filling of grout. As a result, the number of work processes and the work period at a construction site would increase.

According to the above configuration, since the male threaded portion is formed by rolling, the screw pitch can be made small. Thus, a length of the coupler can be made short. In addition, since adhesion of contact surfaces of the screws can be secured, grout filling is unnecessary. As a result, it is possible to omit the grout filling process and steps such as quality management of grout at a construction site, and further a curing period required for hardening of grout is not necessary. Therefore, it is possible to prevent increase in operation steps and a work period at a construction site.

In the threaded reinforcing bar coupling structure of the present invention, strip-shaped flat portions are formed at two locations apart from each other by 180° on the outer peripheral surface of the at least one of the pair of reinforcing bars so as to be straight lines in the cross section perpendicular to the axial direction of the reinforcing bar. Each strip-shaped flat portion is constituted of a straight line as a part of an arc of a circle forming the outer peripheral surface of the reinforcing bar main body and may be formed over an entire length of the reinforcing bar main body in the axial direction.

In the screw node reinforcing bar, the strip-shaped flat portion is formed so as to be able to fill grout in a state where the pair of reinforcing bars are connected by the coupler. In other words, the screw node reinforcing bar has an elliptical cross section. According to the above configuration, grout filling is unnecessary, and thus, the strip-shaped flat portion may be omitted. Therefore, perfect circle processing may be performed to a region of the end portion of the reinforcing bar where a male threaded portion is to be formed, and a male threaded portion may be formed on the perfect circle portion. In this way, it is possible to obtain a male threaded portion that is excellent in proof stress. From an intensive study by the Inventors, it was found that cutting does not affect performance of the reinforcing bar as long as no more than 4% of the cross-sectional area of the shaft portion of the reinforcing bar is cut. Therefore, performance of the reinforcing bar has no problem if the shaft portion of the end portion is precut within such a range and is subjected to perfect circle processing.

In the threaded reinforcing bar coupling structure of the present invention, the reinforcing bar may be a deformed reinforcing bar having the plurality of annular node portions provided so as to be spaced apart in a longitudinal direction of the reinforcing bar and a projection extending in the longitudinal direction;

the male threaded portion may include thick portions having a large thread ridge diameter in multiple locations in width regions corresponding to the node portions and thin portions having a small thread ridge diameter in remaining portions of the male threaded portion except for the same circumferential portions as the projection;

thread groove diameters of both of the thick portions and the thin portions may be mutually the same, and a thread groove depth of the thin portions may be 70% or higher of a thread groove depth of the thick portions; and the thread ridge diameter of the thick portions may be larger than the diameter of the reinforcing bar main body of the reinforcing bar and smaller than a maximum diameter including the projection.

According to this configuration, the present invention can also be applied to a bamboo node reinforcing bar comprising a reinforcing bar main body having a round shaft shape, node portions and ribs.

In the threaded reinforcing bar coupling structure of the present invention, the reinforcing bar may be a deformed reinforcing bar having the plurality of annular node portions provided so as to be spaced apart in a longitudinal direction of the reinforcing bar;

the male threaded portion may include thick portions having a large thread ridge diameter in multiple locations in width regions corresponding to the node portions and thin portions having a small thread ridge diameter in remaining portions of the male threaded portion;

thread groove diameters of both of the thick portions and the thin portions may be mutually the same, and a thread groove depth of the thin portions may be 70% or higher of a thread groove depth of the thick portions; and the thread ridge diameter of the thick portions may be larger than the diameter of the reinforcing bar main body of the reinforcing bar and smaller than a maximum diameter including the node portions.

A conventional deformed reinforcing bar called as a bamboo node reinforcing bar generally includes a reinforcing bar main body having a round shaft shape, node portions and ribs. The ribs also contribute to tensile proof stress and accounts for about 4%. When a male threaded portion is formed on the deformed reinforcing bar, the ribs are interrupted by thread groove portions, causing decrease in tensile proof stress by an amount to which the cross-sectional area of the ribs contribute. Thus, the male threaded portion becomes a portion where tensile proof stress is locally weak.

When the reinforcing bar is formed without projections such as ribs extending in the longitudinal direction, it is avoided that the male threaded portion becomes a portion where tensile proof stress is locally weak. Simply eliminating projections causes decrease in tensile proof stress of the whole reinforcing bar by an amount which the projections contribute, but required strength is still maintained since the male threaded portion has a stronger tensile strength because of work hardening from rolling. In order to reliably achieve required strength, a reinforcing bar that has a reinforcing bar main body having a larger diameter by an amount corresponding to the cross-sectional area of the projections such as ribs may be used.

When deformed reinforcing bars without a projection extending in the longitudinal direction are used, strip-shaped flat portions may be formed at two locations apart from each other by 180° on the outer peripheral surface of the at least one of the pair of reinforcing bars so as to be straight lines in the cross section perpendicular to an axial direction of the reinforcing bar. Each strip-shaped flat portion may be constituted of a straight line as a part of an arc of a circle forming the outer peripheral surface of the reinforcing bar main body and may be formed over the entire length of the reinforcing bar main body in the axial direction. When deformed reinforcing bars having node portions are manufactured, common pressure rolling generates projections that are formed into ribs by a gap between opposing pressure rollers. However, when such ribs are formed during pressure rolling, the ribs may be removed to form strip-shaped flat portions. In this way, by processing the node portions with the use of pressure rolling equipment for forming a common deformed reinforcing bar with node portions and ribs, a deformed reinforcing bar with nodes but without a projection extending in the longitudinal direction can also be formed.

The threaded reinforcing bar coupling structure of present invention may comprise a lock nut that is screwed onto the male threaded portion of the reinforcing bar and abuts with an end surface of the coupler. When a lock nut is provided in such a way, backlash can be prevented in the screw coupling portions. In addition, the contact surfaces of the respective thread ridges of a male threaded portion with a female thread portion of the coupler are not changed when tensile force acts and when compression force acts. Accordingly, both requirements for tensile proof stress and compression proof stress can be satisfied.

A bar arrangement structure of the present invention is a bar arrangement structure in which reinforcing bars that are a plurality of deformed reinforcing bars arranged in a length direction thereof are connected with each other by the threaded reinforcing bar coupling structure of the present invention, wherein a part of the plurality of reinforcing bars is a length adjusting reinforcing bar, and a remaining part of the plurality of reinforcing bars is a standard length reinforcing bar; the male threaded portion of the standard length reinforcing bar is formed in a certain length for use in a threaded reinforcing bar coupling; and the male threaded portion of the length adjusting reinforcing bar is formed longer than the male threaded portion of the standard length reinforcing bar.

A bar arrangement in which a plurality of reinforcing bars are connected using a threaded reinforcing bar coupling structure is used as a main reinforcement of a beam and/or a pillar in a reinforced concrete building. In many cases, lengths of beams and/or pillars in reinforced concrete buildings tend to be standardized by module dimensions, and this can be managed to some extent by preparing standard length reinforcing bars of several types of lengths as reinforcing bars with male threaded portions.

However, there are cases where a reinforced concrete building is constructed in dimensions that deviate from the module. In addition, in the context of accuracy issue, if standard length reinforcing bars are exclusively used as reinforcing bars of a bar arrangement, the lengths of the reinforcing bars may not match. In such cases, it is necessary to manufacture reinforcing bars with male threads of different lengths as specially ordered items, resulting in increase in labor and costs.

According to the bar arrangement structure having this configuration, a male threaded portion of a length adjusting reinforcing bar is formed longer than a male threaded portion of a standard length reinforcing bar, and thus, it is possible to cut the elongated male threaded portion in any length to use it as a male threaded portion in the threaded reinforcing bar coupling. In this way, it is possible to adjust a length of the length adjusting reinforcing bar. Therefore, even if other reinforcing bars are standard length reinforcing bars, it is possible to arbitrary adjust the entire length of this bar arrangement. Accordingly, it is unnecessary to use reinforcing bars with specially ordered male threads and thus, it is possible to save cost by not requiring a specially ordered item. It should be noted that "a certain length for use in threaded reinforcing bar coupling" means any length set within a range between a minimum length to be screwed into a coupler in a use state of a reinforcing bar coupling and a maximum length that allows the entire coupler to be screwed so that the coupler can be temporary kept during a coupler connection operation.

In the bar arrangement structure of the present invention, a confirmation hole for confirming that the pair of reinforcing bars are screwed into the coupler to a predetermined minimum fastening length may be formed in an intermediate location in a length direction of the coupler. One confirmation hole or a plurality of confirmation holes spaced apart in the length direction may be provided. In addition, the confirmation hole may be arranged in any location where it is possible to confirm that the reinforcing bars on both sides are screwed into the coupler to the minimum fastening length using the confirmation hole and is not necessarily arranged at the center in the length direction of the coupler. "A predetermined minimum fastening length" may be designed as necessary. When a confirmation hole is provided, it is possible to easily confirm that reinforcing bars are screwed to a minimum fastening length by viewing from the confirmation hole, or by inserting a pin-shaped jig into the confirmation hole, or by passing light through the confirmation hole.

A first method for manufacturing the threaded reinforcing bar coupling structure for a deformed reinforcing bar of the present invention is a method for manufacturing a threaded reinforcing bar coupling structure for a deformed reinforcing bar according to the present invention, the method comprising: a cutting step for cutting the reinforcing bar into any length; a male thread rolling step for forming a male threaded portion by rolling on an end portion of the cut reinforcing bar without performing a diameter enlarging process; and a preparation step for preparing a coupler to be screwed onto male threaded portions of a pair of reinforcing bars which have been formed with the male threaded portion.

According to this configuration, since the male threaded portion is formed by rolling, the screw pitch can be made small. Thus, a length of the coupler can be made short. In addition, since adhesion of contact surfaces of the screws can be secured, grout filling is unnecessary. As a result, it is possible to omit the grout filling process and steps such as quality management of grout at a construction site, and further a curing period required for hardening of grout is not necessary. Therefore, it is possible to prevent increase in operation steps and a work period at a construction site.

The first method for manufacturing a threaded reinforcing bar coupling structure of the present invention may further comprise a perfect circle processing step for performing perfect circle processing to a length range for forming the male threaded portion on an end portion of the reinforcing bar cut in the cutting step, wherein in the rolling step, rolling may be performed to a portion which has been subjected to perfect circle processing in the perfect circle processing step. According to this configuration, it is possible to perform perfect circle processing to a region of the end portion of the reinforcing bar where a male threaded portion is to be formed, and to form a male threaded portion on the perfect circle portion. In this way, it is possible to obtain a male threaded portion having excellent proof stress. As stated above, cutting of the end portion of the shaft portion and performing perfect circle processing thereto do not affect performance of the reinforcing bar as long as no more than 4% of the cross-sectional area of the shaft portion of the reinforcing bar is cut.

A second method for manufacturing a threaded reinforcing bar coupling structure for a deformed reinforcing bar of the present invention is a method for manufacturing a threaded reinforcing bar coupling structure for a bamboo node deformed reinforcing bar according to the present invention, the method comprising: a cutting step for cutting a deformed reinforcing bar that has a projection on an outer periphery of a reinforcing bar main body into any length; a male thread rolling step for forming a male threaded portion by rolling on an end portion of the cut reinforcing bar without performing a diameter enlarging process; and a preparation step for preparing a coupler to be screwed onto male threaded portions of a pair of reinforcing bars which have been formed with the male threaded portion.

According to this method, it is possible to obtain a reinforcing bar with a male threaded portion for constituting a threaded reinforcing bar coupling structure only by cutting a deformed reinforcing bar into any length and rolling a male threaded portion. Hardness required for the male threaded portion to compensate partial loss of area accompanying thread forming can also be obtained from work hardening from rolling since the male threaded portion is formed by rolling. Accordingly, a dedicated process for enhancing hardness is not required, which also contributes to excellent productivity.

The second method for manufacturing a threaded reinforcing bar coupling structure for a deformed reinforcing bar of the present invention may comprise a perfect circle processing step for performing perfect circle processing of the outer diameter to a length range of the end portion of the reinforcing bar where the male threaded portion is formed, to an extent that projections are substantially eliminated after the cutting step, and the rolling step may be performed after this perfect circle processing step. A required male threaded portion can be obtained by simply performing rolling to the deformed reinforcing bar. However, since the deformed reinforcing bar has projections such as node portions and ribs, burrs may be generated by rolling. By performing rolling after perfect circle processing, generation of the burrs is solved, and a male threaded portion can be accurately obtained. Perfect circle processing may be performed to an extent that the projections such as the node portions and ribs are removed or to an extent that base end portions of the projections are left. It is not preferable to make it unnecessary thin, since that can cause decrease in proof stress due to diameter thinning.

A method for constructing a bar arrangement according to the present invention, in which reinforcing bars that are a plurality of deformed reinforcing bars arranged in a length direction thereof are connected by the threaded reinforcing bar coupling structure of the present invention, comprises: preparing a plurality of standard length reinforcing bars, a length adjusting reinforcing bar and a plurality of the couplers, wherein the male threaded portions of the standard length reinforcing bars are formed in a certain length for use in the threaded reinforcing bar coupling, and the male threaded portion of the length adjusting reinforcing bar is formed longer than the male threaded portions of the standard length reinforcing bars; cutting the male threaded portions of the length adjusting reinforcing bars to adjust a length of an entire bar arrangement in which the standard length reinforcing bars and the length adjusting reinforcing bars are arranged in the length direction to an entire length of one bar arrangement; and connecting the adjacent reinforcing bars with each other by using the plurality of the couplers.

According to the method for constructing a bar arrangement, as stated above, by using a length adjusting reinforcing bar with an elongated male threaded portion, it is possible to adjust a length while maintaining a configuration that the reinforcing bar has a male threaded portion required as a reinforcing bar coupling. As a result, even if other reinforcing bars are standard length reinforcing bars, it is possible to arbitrary adjust the entire length of this bar arrangement. Therefore, it is unnecessary to use reinforcing bars with specially ordered male threads, and thus, it is possible to save cost by not requiring a specially ordered item.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation and are not to be taken as limiting the scope of the present invention in any way whatsoever, which scope is to be determined by the appended claims. In the accompanying drawings, like reference numerals are used to denote like parts throughout the several views, and:

DESCRIPTION OF EMBODIMENTS

Figure 1A:
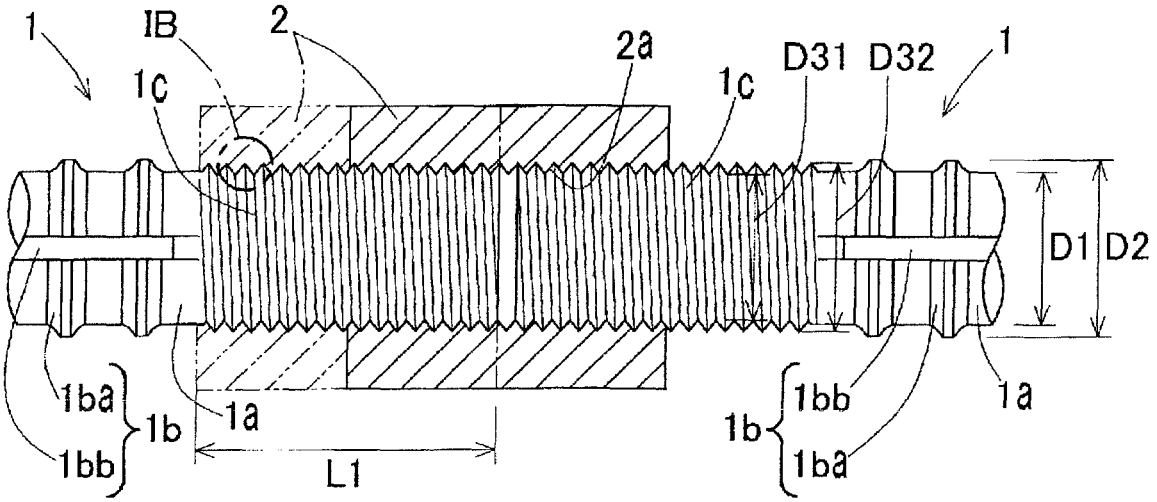
FIG. 1A is a sectional view of a threaded reinforcing bar coupling structure for a deformed reinforcing bar according to a first embodiment of the present invention.

A first embodiment of the present invention will be described with reference to FIGS. 1A to 3D. The threaded reinforcing bar coupling structure for a deformed reinforcing bar connects a pair of reinforcing bars 1, 1 with each other, in which male threaded portions 1*c* are formed on opposite end portions of the pair of reinforcing bars 1, 1 connected to each other and a coupler 2 is screwed onto the male threaded portions 1*c*, 1*c* of both reinforcing bar 1, 1. Both male threaded portions 1*c*, 1*c* are threaded in the same direction in the present embodiment, but may be inversely threaded to each other. The coupler 2 is shaped as a screw cylinder made of steel formed with a female thread portion 2*a* to be screwed onto the respective male threaded portions 1*c*, 1*c*. An outer peripheral surface of the coupler 2 may have a cylindrical surface or may have a polygonal shape over a part or the entirety of a length in a length direction thereof so as to be engaged by a tool for screw fastening (not shown) or have a flat surface on a part of the surface.

Each of the reinforcing bars 1 is a deformed reinforcing bar having a reinforcing bar main body 1*a* having a round shaft shape and projections 1*b* on an outer peripheral surface of the reinforcing bar main body 1*a*. In the present embodiment, the projections 1*b* includes: node portions 1*ba* that extends in a circumferential direction of the reinforcing bar main body 1*a* and are disposed at a predetermined interval in a longitudinal direction of the reinforcing bar; and ribs 1*bb* that extend in the longitudinal direction. The ribs 1*bb* are provided at two locations apart from each other by 180° on the reinforcing bar main body 1*a*. Each of the node portions 1*ba* has an annular shape extending over the circumference. The node portions 1*ba* may be shaped in such a way that semi-circles extending between two ribs 1*bb*, 1*bb* are alternately arranged in the longitudinal direction of the reinforcing bar. In addition, the projections 1*b* are not limited to the shape constituted of the node portions 1*ba* and ribs 1*bb* and, for example, may be shaped as a projection extending spirally, or may be shaped as two crossed spirals forming rhombic shapes by mutual intersections.

The male threaded portions 1*c*, 1*c* of the respective reinforcing bars 1, 1 are rolled threads and have higher hardness at least in the surface part than that of the remaining portion of the reinforcing bars 1, 1 due to work hardening (also called as plastic hardening).

A relation between diameter dimensions in the male threaded portion 1*c* will be described. The male threaded portion 1*c* of the reinforcing bar 1, as described later, is formed by performing perfect circle processing to the node portions 1*ba* and the ribs 1*bb*, in order to improve accuracy of thread forming, to such an extent that the perfect circle processing leaves base ends of the node portions 1*ba* and the ribs 1*bb* and then by performing thread forming. Therefore, the male threaded portion has different dimensions for portions with and without the node portions 1*ba* as follows. It should be noted that the male threaded portion 1*c* has the same diameter dimension in axial width portions with the node portions 1*ba* with that in axial width portions without the node portions 1*ba* in terms of the entire circumference (a maximum diameter), since the portions with the ribs 1*bb* have the same maximum diameter as the portions with the node portions 1*ba*.

The relation between the diameter dimensions will be specifically described. Since a diameter D5 (FIG. 1B) of a perfect circle made by perfect circle processing is larger than an outer diameter D1 of the reinforcing bar main body 1*a*, the portion of the reinforcing bar main body 1*a* within a length range subjected to perfect circle processing is left unprocessed. The male threaded portion 1*c* has a thread groove diameter D31 smaller than the outer diameter D1 of the reinforcing bar main body and is formed over the potion 1*ba*' which has been processed by perfect circle processing in the reinforcing bar main body 1*a* and the node portions 1*ba* which has a larger diameter than that of the main body 1*a*. Therefore, as shown in FIG. 1B, the male threaded portion 1*c* has different thread ridge diameters in portions formed from the reinforcing bar main body 1*a* and the potion 1*ba*' where the node portions 1*ba* has been processed by perfect circle processing. Both portions have the same thread groove diameter of D31.

A thread groove depth h1 in the male threaded portion 1*c* formed on the reinforcing bar main body 1*a* is set within the range of e.g. 75-80%, and 75% in this example, of a thread groove depth h0 of the potion 1*ba*' of the node portions 1*ba* which has been processed by perfect circle processing. It should be noted that it is confirmed by simulations that the portions of the male threaded portion 1*c* which have been processed by thread forming on the reinforcing bar main body 1*a* do not interfere fastening as the reinforcing bar coupling structure if a ratio h1/h0 of the thread groove depths is 70% or higher.

An example of diameter dimensions of respective portions of the reinforcing bar 1 will be described. When a male threaded portion 1*c* with M20 (an outer diameter of 20) and a pitch of 2.5 is processed on the reinforcing bar having a nominal diameter D19, the reinforcing bar main body 1*a* has an outer diameter D1 of 17.88, a maximum diameter D2 (an outer diameter of the node portions 1*ba*) of 20.68, a thread ridge diameter D32 of 19.674, a thread effective diameter D30 of 18.05, and a thread groove diameter D31 of 16.607 (unit: mm).

Figure 1B:
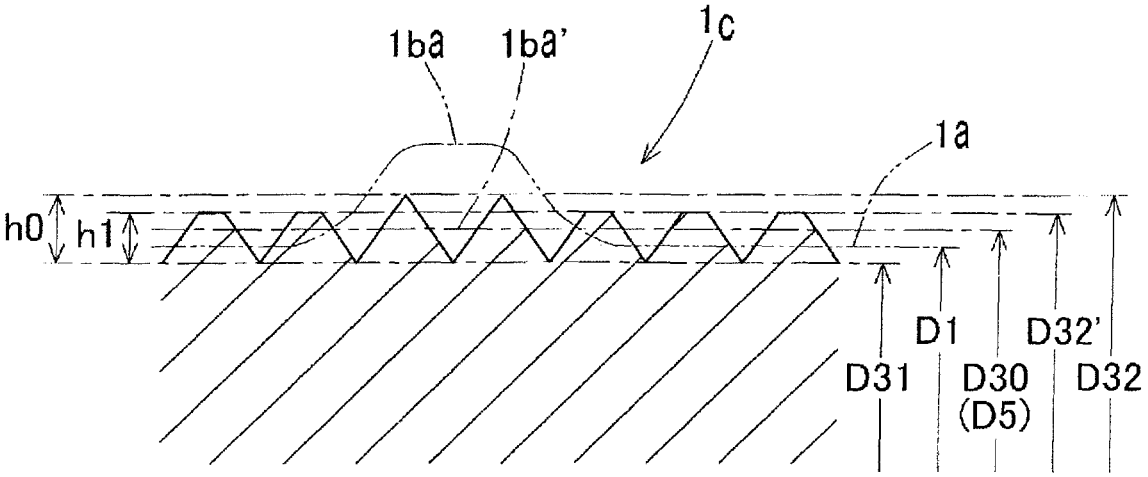
FIG. 1B is an enlarged sectional view of a portion denoted by IB in FIG. 1A.
Figure 2:
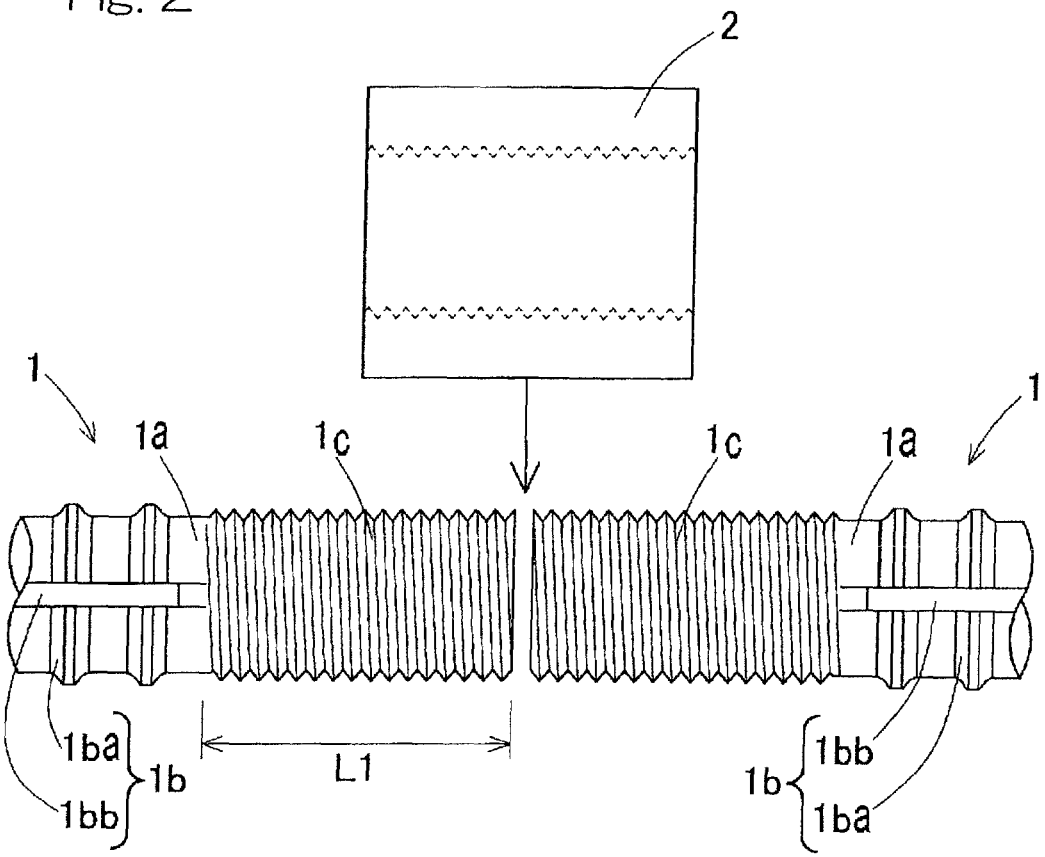
FIG. 2 is a front view of the threaded reinforcing bar coupling structure in a disassembled state.

A length L1 (FIG. 2) of the male threaded portion 1*c* may be a required length for screwing into the coupler 2, but may preferably be a length that allows the entire coupler 2 to be screwed onto as shown with a double dotted line in FIG. 1A. In this way, during a connection operation of reinforcing bars, it is possible to screw an entire coupler 2 onto a male threaded portion 1*c* of a first reinforcing bar 1 of a pair of reinforcing bars and then screw the coupler 2 onto a male threaded portion 1*c* of a second reinforcing bar 1 of the pair of reinforcing bars by screwing it back after end surfaces of both reinforcing bars 1, 1 are butted against each other. Therefore, it is unnecessary to screw the reinforcing bar 1 into a coupler while pulling the reinforcing bar, and workability of connection operations on construction site is enhanced. A cross-sectional shape of a thread groove of the male threaded portion 1*c* may be triangular or trapezoidal.

With reference to FIGS. 3A to 3D, a method for manufacturing a threaded reinforcing bar coupling structure for a deformed reinforcing bar will be described. A coupler 2 which is not shown in these figures is also prepared.

Figure 3A:
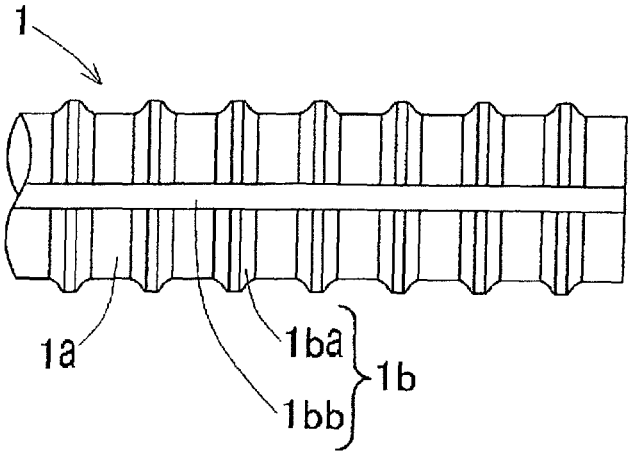
FIG. 3A illustrates a preparing step in a manufacturing process of the threaded reinforcing bar coupling structure.
Figure 3B:
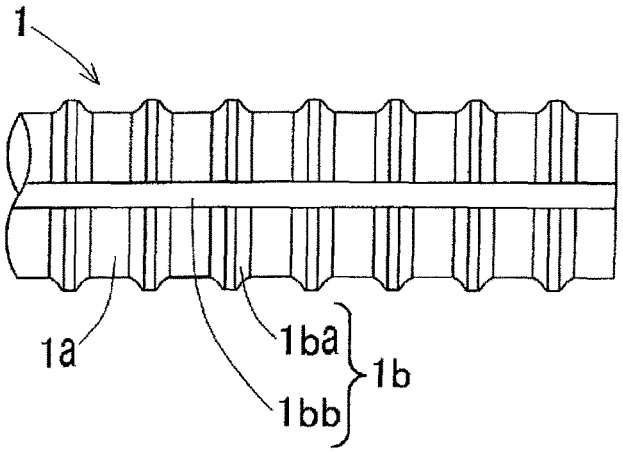
FIG. 3B illustrates a cutting step in a manufacturing process of the threaded reinforcing bar coupling structure.
Figure 3C:
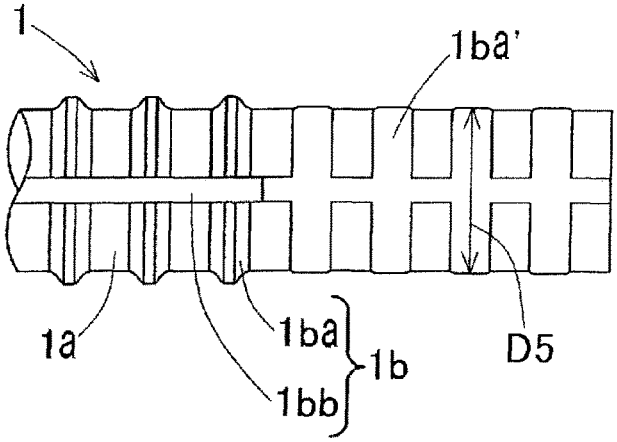
FIG. 3C illustrates a perfect circle processing step in a manufacturing process of the threaded reinforcing bar coupling structure.

FIG. 3A shows a reinforcing bar 1 which is a raw material deformed reinforcing bar (preparing step). The reinforcing bar 1 is cut into any length as required at a construction site or a factory and the like (cutting step; FIG. 3B). Then, perfect circle processing is performed to a portion of an end portion of the cut reinforcing bar 1 within a length range for forming a male threaded portion 1*c* (perfect circle processing step; FIG. 3C).

In the perfect circle processing step, as stated above, a process is carried out for cutting projections 1*b* constituted of node portions 1*ba* and ribs 1*bb* of a reinforcing bar 1 to such an extent that it leaves base ends of the projections (to such an extent that it substantially eliminates the projections) into a perfect circle having an outer diameter of D5 (FIG. 1B). By performing perfect circle processing, the node portions 1*ba* become potions 1*ba*' with a low projection height. The outer diameter D5 is slightly larger than the outer diameter D1 of the reinforcing bar main body 1*a*. Since the diameter slightly changes with thread forming, the outer diameter D5 is different from the thread ridge diameter D32 of the male threaded portion 1*c*. It should be noted that the outer diameter D5 may be equal to or slightly smaller than the outer diameter D1 of the reinforcing bar main body 1*a*.

Figure 3D:
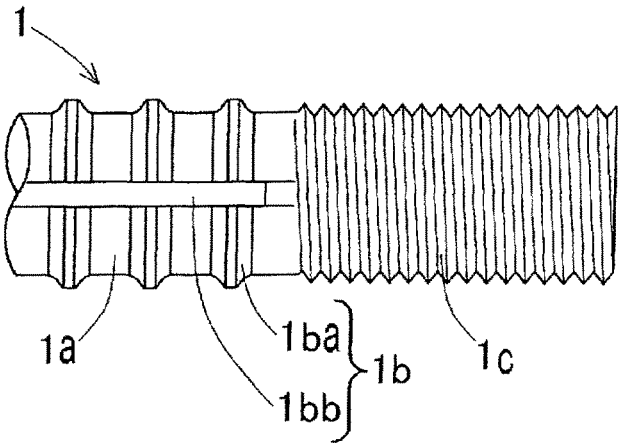
FIG. 3D illustrates a male thread rolling step in a manufacturing process of the threaded reinforcing bar coupling structure.

A male threaded portion 1*c* (an effective diameter D30) is formed by rolling on the portions of the reinforcing bar 1 that have been processed by perfect circle processing in such a way (male thread rolling step; FIG. 3D). When the male threaded portion 1*c* is formed by rolling, the thread ridge diameter D32 is rendered to be larger than the outer diameter D5 after perfect circle processing due to composition flow, and the effective diameter D30 is rendered to be the outer diameter D5 after perfect circle processing. The rolling process is performed by using, for example, a rolling tool that fit to the outer periphery of the reinforcing bar 1 (not shown) or a rolling facility constituted of a pair of opposite rolling rollers (not shown) in a cold, warm, or hot state. The rolling process is, for example, so-called three-point rolling, processing in which thread forming is performed at three points.

By performing rolling of the male threaded portion 1*c* in this way, the male threaded portion 1*c* is hardened due to work hardening. In addition, the thread groove diameter D31 of the male threaded portion 1*c* is rendered to be smaller than the outer diameter D1 of the reinforcing bar main body 1*a*, and the thread ridge diameter D32' is rendered to be thicker than the outer diameter D1 of the reinforcing bar main body 1*a* because of swell during rolling. It should be noted that perfect circle processing (FIG. 3C) may not necessarily be performed. In addition, the length of the male threaded portion 1*c* to be subjected to perfect circle processing and rolling may be set to be long for length adjustment, so that the male threaded portion 1*c* can be cut according to places for use at a construction site of bar arrangement to be used in a reinforcing bar coupling structure. Construction performance is thus enhanced.

According to the reinforcing bar coupling structure having this configuration, both reinforcing bars 1, 1 can be connected by screwing the male threaded portions 1*c*, 1*c* of the pair of reinforcing bars 1, 1 into the coupler 2, and thus this coupling structure contributes to simplification of bar arrangement and a shorter construction period in a similar way to common reinforcing bar couplings. The male threaded portion 1*c* has a thread groove diameter D31 smaller than the outer diameter D1 of the reinforcing bar main body 1*a* and a thread ridge diameter D32 larger than the outer diameter D1 and smaller than the maximum diameter D2 of the reinforcing bar main body 1*a*. Therefore, it is possible to form a male threaded portion 1*c* without preprocessing a raw material deformed reinforcing bar 1 or only with preprocessing by perfect circle processing. The male threaded portion 1*c* can be formed by performing thread forming to the deformed reinforcing bar 1, without performing large scale preprocessing, such as diameter enlargement, and thus is excellent in productivity.

Decrease in proof stress such as tensile strength of the reinforcing bar in the coupling portion is concerned, because the thread groove diameter D31 of the male threaded portion 1*c* is smaller than the outer diameter D1 of the reinforcing bar main body 1*a*. However, since hardness of the male threaded portion 1*c* is greater than that of the remaining portion, the decrease in proof stress can be compensated, and therefore, sufficient proof stress can be achieved.

Hardness required for compensating the decrease in proof stress due to groove processing of the male threaded portion 1*c* can be sufficiently obtained from work hardening by rolling the male threaded portion 1*c*. Therefore, hardness required for the male threaded portion 1*c* can also be obtained by simply rolling the male threaded portion on the deformed reinforcing bar 1. Accordingly, a dedicated process for enhancing hardness of the male threaded portion 1*c* is not required, which also contributes to excellent productivity. If couplers 2 are prepared, work that is left is merely to cut deformed reinforcing bars 1 and to roll male threaded portions 1*c*, and thus can be performed at a construction site.

FIGS. 4 to 6B show a second embodiment of the present invention. The threaded reinforcing bar coupling structure for a deformed reinforcing bar in the second embodiment includes a pair of lock nuts 3, 3 in addition to the threaded reinforcing bar coupling structure of the first embodiment described above with reference to FIGS. 1A to 3D. The pair of lock nuts 3, 3 are screwed onto the male threaded portions 1*c*, 1*c* of the respective reinforcing bars 1, 1 and abut on the end surfaces of the couplers 2. An outer peripheral surface of the lock nut 3 may be round or polygonal. In the present embodiment, a length L1 of the male threaded portion 1*c* may be, for example, a length that allows the lock nuts 3 and the coupler 2 in their entirety to be temporarily screwed onto a male threaded portion 1*c* on one side. The second embodiment is the same as the first embodiment except for matters specifically described.

Figure 6A:
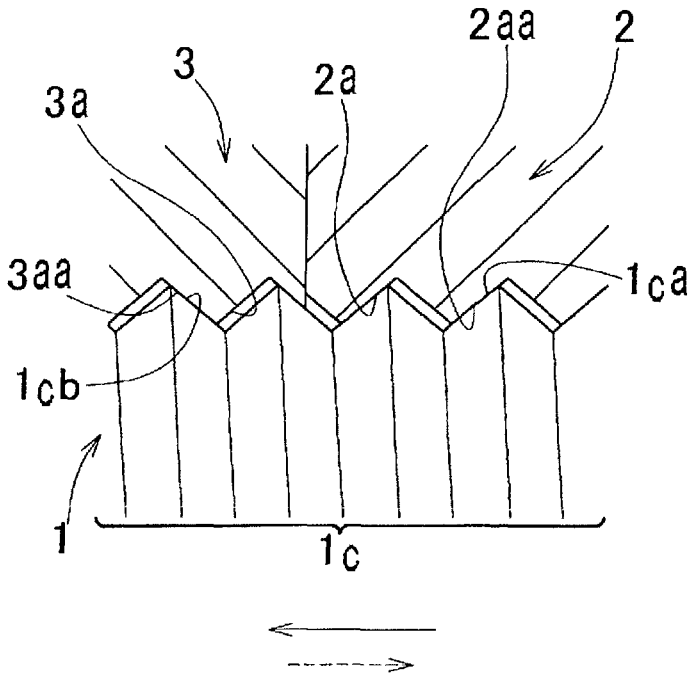
FIG. 6A illustrates force acting between a coupler and a first lock nut of the threaded reinforcing bar coupling structure.
Figure 6B:
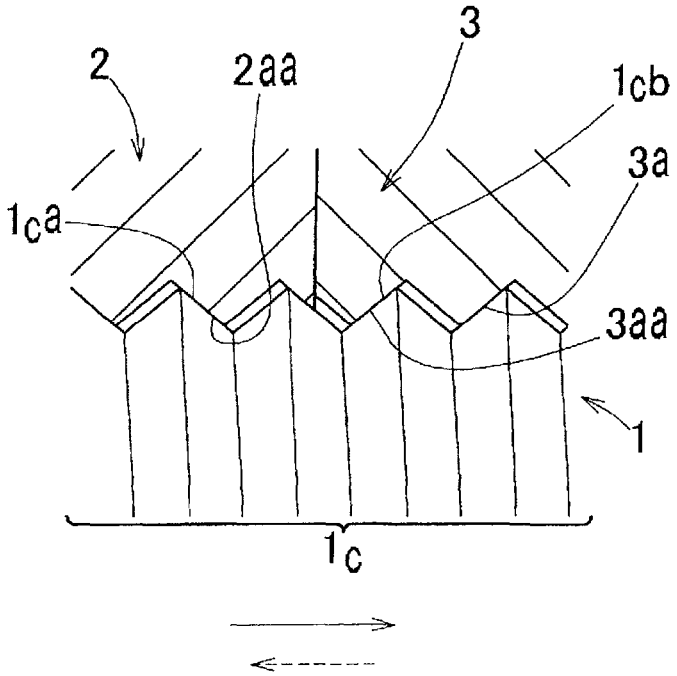
FIG. 6B illustrates force acting between a coupler and a second lock nut of the threaded reinforcing bar coupling structure.
Figure 7:
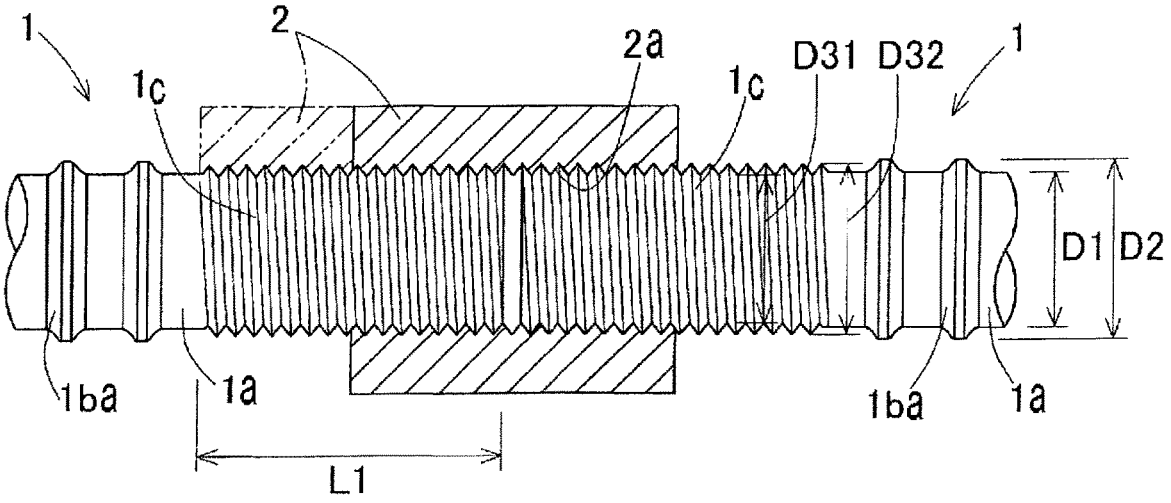
FIG. 7 is a sectional view of a threaded reinforcing bar coupling structure for a deformed reinforcing bar according to a third embodiment of the present invention.
Figure 8:
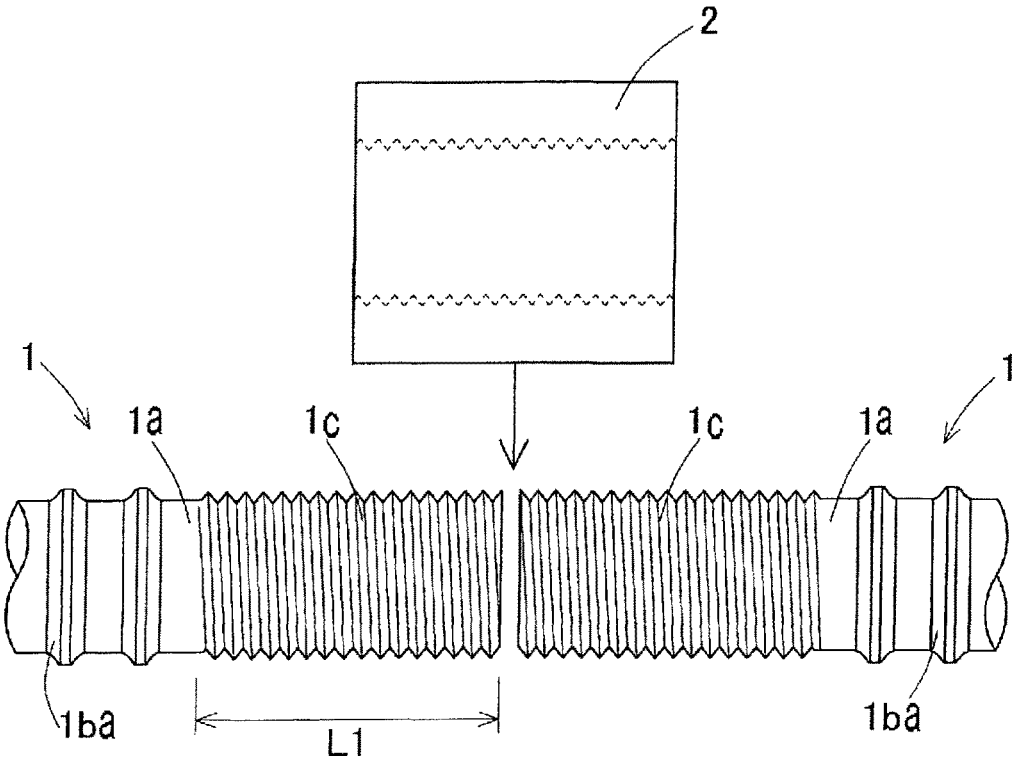
FIG. 8 is a front view of the threaded reinforcing bar coupling structure in a disassembled state.
Figure 9A:
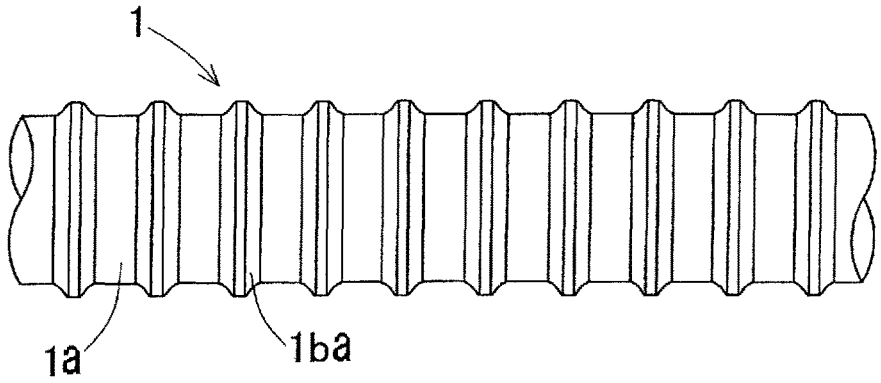
FIG. 9A illustrates a preparing step in a manufacturing process of the threaded reinforcing bar coupling structure.
Figure 9B:
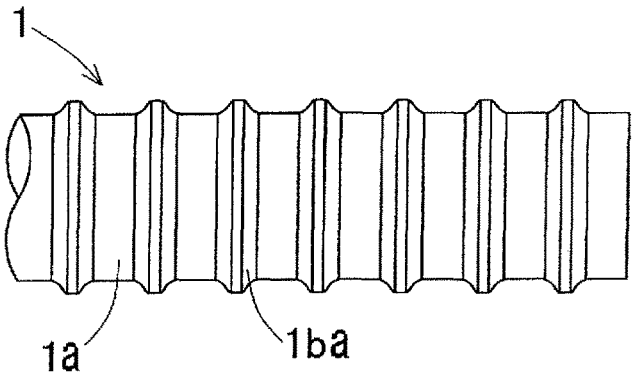
FIG. 9B illustrates a cutting step in a manufacturing process of the threaded reinforcing bar coupling structure.
Figure 9C:
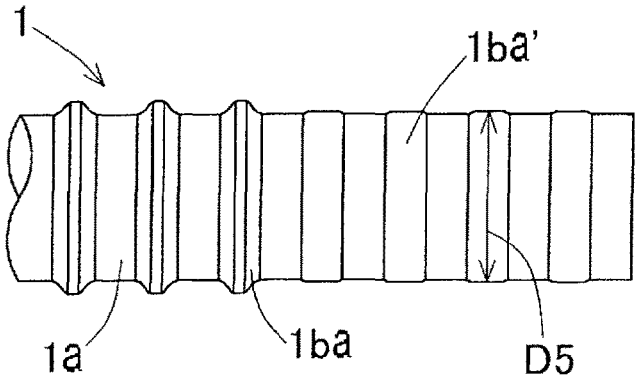
FIG. 9C illustrates a perfect circle processing step in a manufacturing process of the threaded reinforcing bar coupling structure.
Figure 9D:
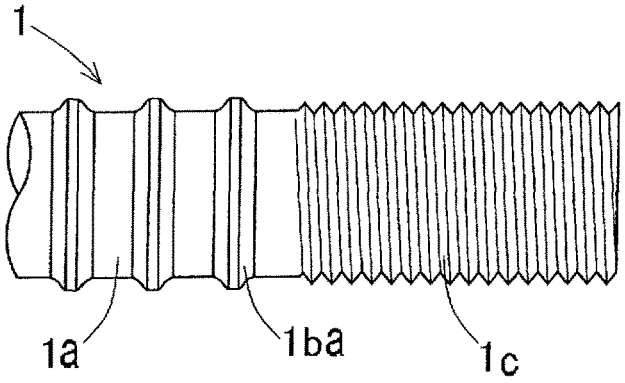
FIG. 9D illustrates a male thread rolling step in a manufacturing process of the threaded reinforcing bar coupling structure.
Figure 10A:
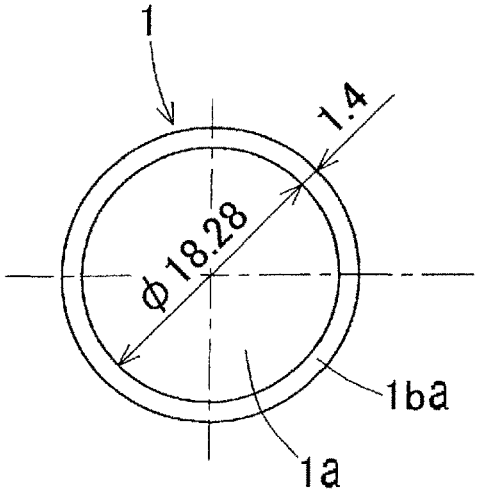
FIG. 10A is a front view showing an example of a shape and dimensions of a deformed reinforcing bar used in the third embodiment.
Figure 10B:
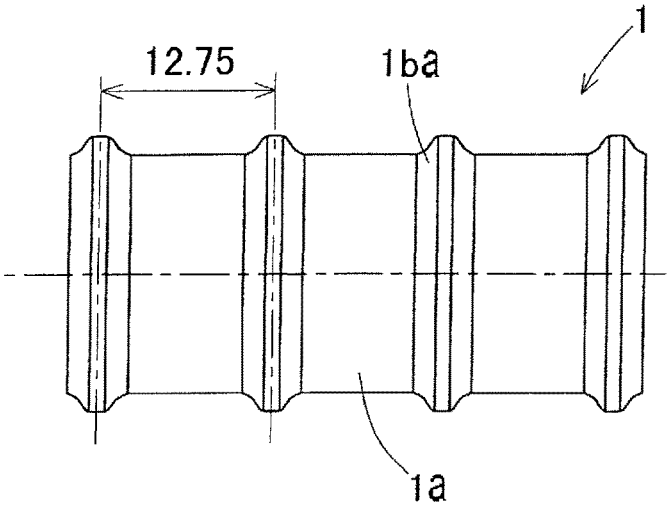
FIG. 10B is a side view an example of a shape and a dimension of a deformed reinforcing bar used in the third embodiment.

In the case of the threaded reinforcing bar coupling structure having this configuration, tensile force and compression force can be transmitted as follows. With reference to FIGS. 6A and 6B, the transmission of tensile force and compression force will be described. When tensile force (the solid arrows in FIGS. 6A, 6B) acts on the reinforcing bars 1, 1 on both sides, the tensile force is transmitted from faces lea of thread ridges of the male threaded portion 1*c* of the reinforcing bar 1 on the side of the coupler 2 to faces 2*aa* of thread ridges of the female thread portion 2*a* of the coupler 2 on the screw cylinder center side. The tensile force is thus directly transmitted from a first reinforcing bar 1 to the nut 2 and then to a second reinforcing bar 1. Therefore, strength of engagement of the lock nut 3 does not influence transmission of tensile force.

When compression force (the broken arrows in FIGS. 6A, 6B) acts on the reinforcing bars 1, 1 on both sides, the compression force is transmitted from faces 1*cb* of the thread ridges of the male threaded portion 1*c* of the reinforcing bar 1 on the side opposite to the coupler to faces 3*aa* of thread ridges of the female thread portion 3*a* of the lock nut 3 on the screw cylinder side. The transmitted compression force is then transmitted from the contact surfaces between the lock nut 3 and the coupler 2 to the coupler 2. In other words, the compression force is transmitted from a first reinforcing bar 1 to a second reinforcing bar 1 via a first lock nut 3, the coupler 2 and a second lock nut 3.

To this end, the width C (FIG. 4) of the lock nut 3 is so set that compression proof stress required for the reinforcing bar coupling structure can be secured. It should be noted that compression proof stress required for the reinforcing bar coupling structure is sufficiently met by compression resistance of about half of yield point strength. Therefore, a tightening length of the lock nut 3 can be a smaller dimension compared to a tightening length to the coupler 2. In this respect, an axial width C of each lock nut 3 is, for example, an axial width that allows the lock nut to be screwed onto at least two thread ridges of a male threaded portion 1*c*. In the case of the present embodiment, both requirements of tensile proof stress and compression proof stress can be satisfied as described above.

FIGS. 7 to 10B show a third embodiment of the present invention. The threaded reinforcing bar coupling structure for a deformed reinforcing bar in the third embodiment is different from the threaded reinforcing bar coupling structure of the first embodiment in FIGS. 1A to 3D, in that each of the reinforcing bars 1, 1 is constituted of a deformed reinforcing bar that has the node portions 1*ba* but does not have projection extending in the longitudinal direction. The male threaded portion 1*c* is constituted of a rolled thread, and as precutting for the rolled thread, perfect circle processing is performed as shown in FIG. 9C, as in FIG. 3C. In this case, perfect circle processing is performed only to the node portions 1*ba* because it does not have ribs. Roundness is corrected to some extent by rolling if the reinforcing bar main body 1*a* of the reinforcing bar 1 has a radius within an effective radius of the male threaded portion 1*c*. Small ribs 1*bb* may sometimes appear on the reinforcing bar 1 in the pressure rolling process, but in that case, such ribs have little influence on the entire cross-sectional area and thus cause no problem. The third embodiment is the same as the first embodiment except for matters specifically described, and description that overlaps with the previous description is omitted. However, the example dimensions of the third embodiment slightly differ as follows.

The third embodiment has following advantages as compared with the first embodiment. A conventional deformed reinforcing bar called as a bamboo node reinforcing bar generally includes a reinforcing bar main body having a round shaft shape, node portions and ribs. The ribs also contribute to tensile proof stress and accounts for about 4%. When a male threaded portion 1*c* is formed on the deformed reinforcing bar as in the first embodiment, the ribs are interrupted by thread groove portions, causing decrease in tensile proof stress by an amount to which the cross-sectional area of the ribs 1*bb* contribute. Thus, it is concerned that the male threaded portion 1*c* becomes a portion where tensile proof stress is locally weak. In the first embodiment, the problem of strength decrease due to formation of a male threaded portion 1*c* does not occur because the male threaded portion 1*c* is formed by rolling and thus tensile strength is enhanced by work hardening. It should be noted that it is preferable to more reliably ensure higher strength.

The third embodiment shown in FIGS. 7 to 10B more reliably ensures strength by making the diameter of the reinforcing bar slightly larger as follows. In other words, the third embodiment uses a reinforcing bar having a diameter of a reinforcing bar main body 1*a* that is larger by an amount corresponding to the cross-sectional area of the ribs 1*bb* in the first embodiment.

Figure 11A:
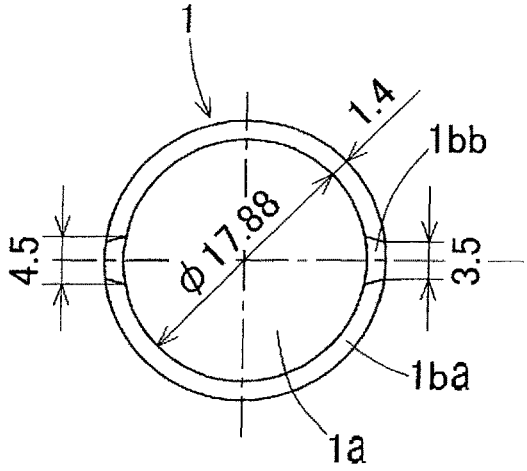
FIG. 11A is a front view showing an example of a shape and dimensions of a deformed reinforcing bar used in the first embodiment.
Figure 11B:
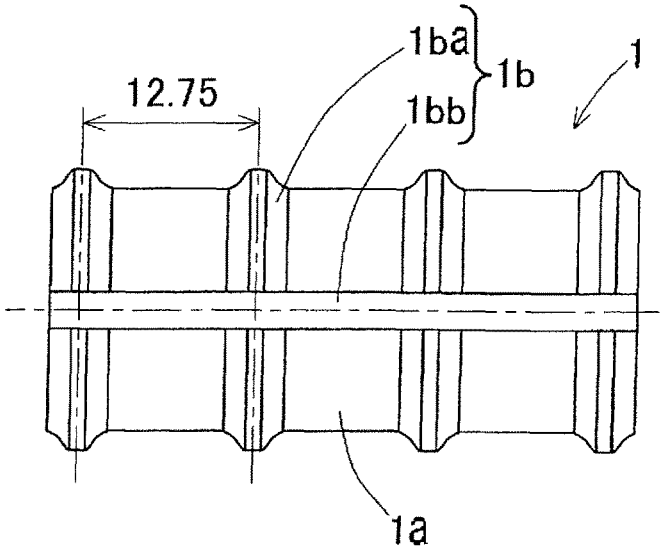
FIG. 11B is a side view showing an example of a shape and a dimension of a deformed reinforcing bar used in the first embodiment.

An example dimensions will be described with reference to FIGS. 10A to 11B. In the first embodiment, when, for example, a reinforcing bar 1 with D19 is used, the reinforcing bar main body 1*a* has a diameter of 17.88, and the rib 1*bb* has a trapezoidal cross-sectional shape with an upper bottom of 3.5, a lower bottom of 4.5 and a height of 1.4, as shown in FIGS. 11A and 11B, conforming to the standard. The unit of the dimensions is mm. The same unit is used hereinafter, and areas are expressed in $mm^2$.

Where A0 represents the cross-sectional area of the reinforcing bar main body 1*a*, A1 represents the cross-sectional area of the rib, and A represents the total cross-sectional area:

$$A0=\pi(17.88/2)^2=251.09$$

$$A1=(3.5+4.5)\times1.4/2\times2\approx11.2$$

$$A=A0+A1=251.09+11.2=262.29$$

$$A1/A=0.043(4.3\%)$$

In the third embodiment, the diameter of the reinforcing bar main body 1*a* is set to 18.28 mm. In this case, the cross-sectional area AA of the reinforcing bar main body 1*a* is:

$$AA=\pi(18.28/2)^2=262.31$$

Thus, by increasing the diameter of the reinforcing bar main body 1*a* from 17.88 mm to 18.28 mm, strength similar to that of the reinforcing bar 1 with ribs in FIG. 11A is secured without forming ribs. Partial loss of cross-section due to thread forming is thus solved, and this improves performance as a coupling.

Figure 12:
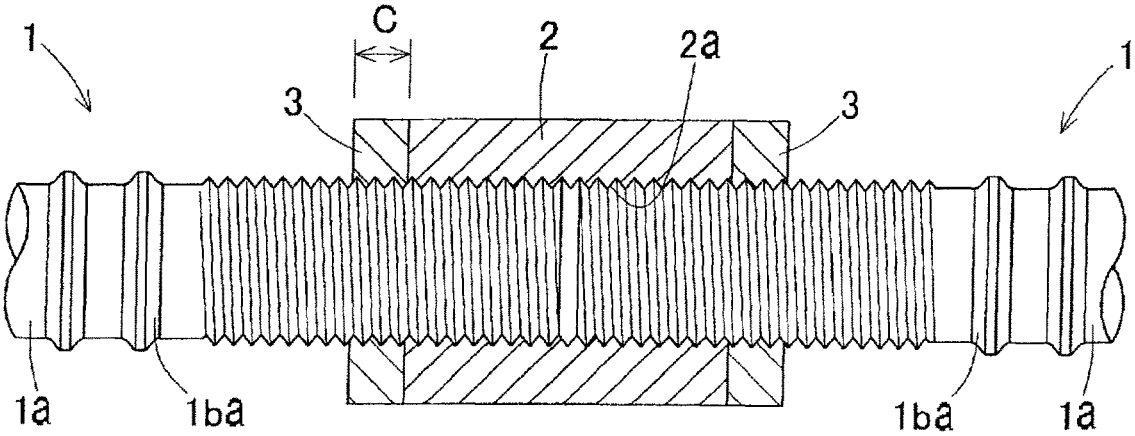
FIG. 12 is a sectional view of a threaded reinforcing bar coupling structure for a deformed reinforcing bar according to a fourth embodiment of the present invention.
Figure 13:
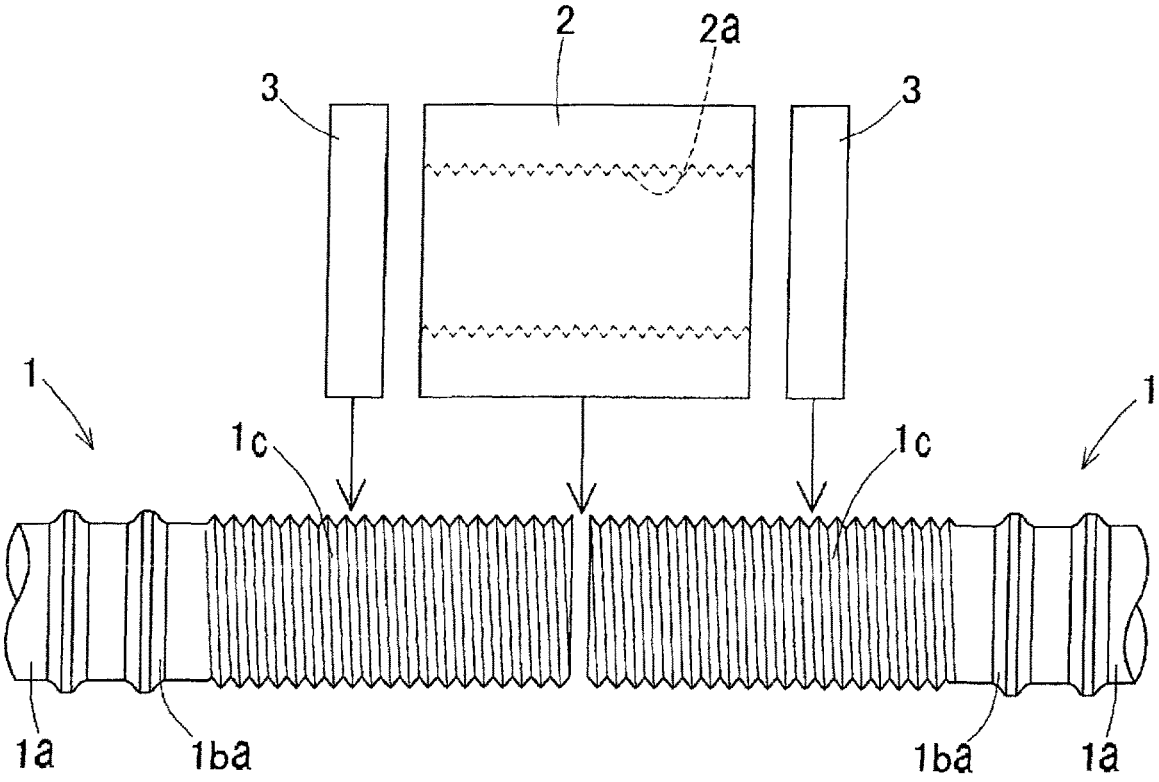
FIG. 13 is a front view of the threaded reinforcing bar coupling structure in a disassembled state.

FIGS. 12, 13 show a threaded reinforcing bar coupling structure according to a fourth embodiment of the present invention. The fourth embodiment uses the reinforcing bar 1 in the third embodiment shown in FIGS. 7 to 10B and the lock nuts 3 as in the second embodiment shown in FIGS. 4 to 6B. Except for that, the fourth embodiment is the same as the second embodiment described above along with FIGS. 4 to 6B.

FIGS. 14A to 19 show a threaded reinforcing bar coupling structure according to a fifth embodiment of the present invention and a method for manufacturing thereof. The fifth embodiment is the same as the first embodiment except for matters specifically described. In the fifth embodiment, the reinforcing bar 1 has planer strip-shaped flat portions 4 at two locations apart from each other by 180° on the outer peripheral surface over the entire axial length. As shown in FIG. 14B, the strip-shaped flat portions 4 are shaped so as to be straight lines as parts of an arc of a circle forming the outer peripheral surface of the main body 1*a* in the cross section perpendicular to the axial direction of the reinforcing bar 1. The strip-shaped flat portions 4 has a wider width at locations of the node portions 1*ba* of the reinforcing bar 1 as they are planer. A width d1 of the general portion (the reinforcing bar main body 1*a*) of the strip-shaped flat portions 4 is equal to or greater than a width of the base ends of the ribs 1*bb*. The node portions 1*ba* are non-continuous at two locations in the circumferential direction because the strip-shaped flat portions 4 are formed. FIG. 14C shows a variant of the reinforcing bar 1, which is described later in detail.

Figure 19:
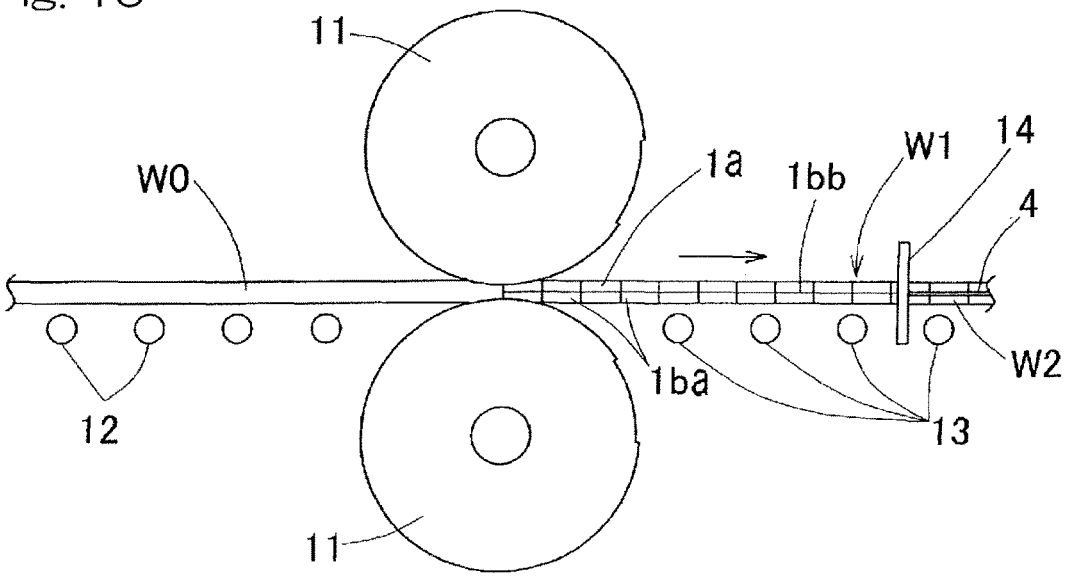
FIG. 19 illustrates a pressure rolling step and a rib removing step of a reinforcing bar in the threaded reinforcing bar coupling structure.

A method for manufacturing a reinforcing bar 1 with the strip-shaped flat portions 4 will be described. First, as shown in FIG. 19, from a reinforcing bar raw material W0 having a round shaft shape, an intermediate reinforcing bar raw material W1 (FIGS. 15A, 15B) with node portions 1*ba* on the outer periphery of the reinforcing bar main body 1*a* having a round shaft shape is obtained by pressure rolling using a pair of pressure rollers 11, 11 in a hot state (pressure rolling step). In this process, ribs 1*bb* are necessarily formed by a gap between the pair of pressure rollers 11, 11 on both sides of the intermediate reinforcing bar raw material W1 over the entire length thereof.

From the intermediate reinforcing bar raw material W1 in a heated state which has been formed in the pressure rolling step, the ribs 1*bb* on both sides are scraped off by a rib remover 14 disposed at a later stage of the pressure rollers 11. In this way, the intermediate reinforcing bar raw material is processed into a raw material reinforcing bar W2 for thread forming (FIGS. 16C, 16B) that has strip-shaped flat portions 4 at two locations apart from each other by 180° on its outer peripheral surface (rib removing step). The rib remover 14 is a tool with a tip in a form of plate or block. By installing and fixing the rib remover 14 in a position, the ribs 1*bb* are scraped off as the intermediate reinforcing bar raw material W1 is fed. Feeding of the intermediate reinforcing bar raw material W1 can be achieved, for example, by using a part of guide rollers 12, 13 as driving rollers to rotationally drive the raw material. The guide rollers 12, 13 are arranged before and after the pressure rollers 11 along the direction of reinforcing bar feeding. The raw material reinforcing bar W2 for thread forming that has the strip-shaped flat portions 4 is formed as a straight material and cut into a predetermined length. However, in some cases, a thin raw material reinforcing bar W2 is manufactured as a coiled raw material.

Figure 17:
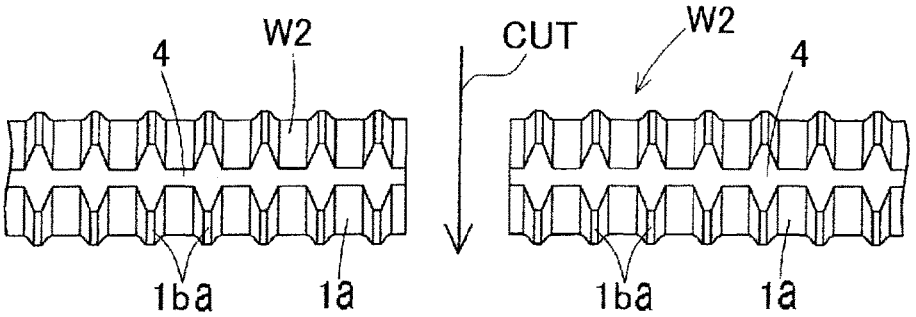
FIG. 17 illustrates a cutting step in a manufacturing process of the threaded reinforcing bar coupling structure.
Figure 18:
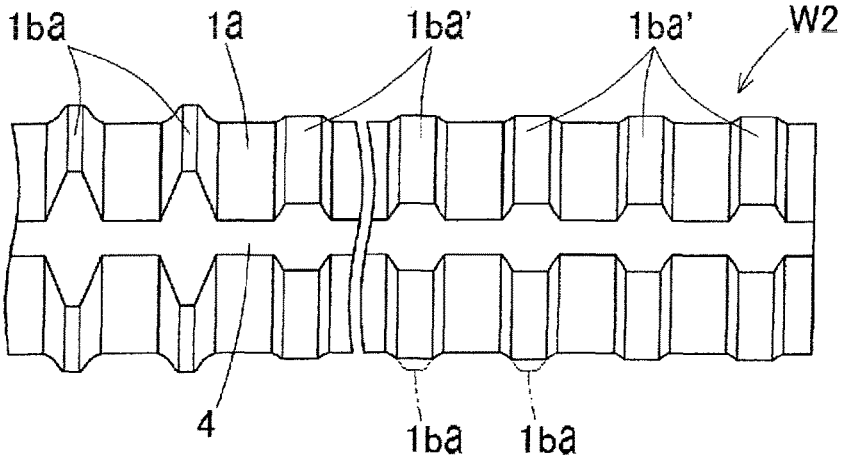
FIG. 18 illustrates a perfect circle processing step in a manufacturing process of the threaded reinforcing bar coupling structure.

The elongated raw material reinforcing bar W2 for thread forming prepared in this way is cut into any length, as shown by an arrow CUT in FIG. 17, to be used at a construction site of bar arrangement or a factory (cutting step). By performing perfect circle processing to the cut raw material reinforcing bar W2 for thread forming, the node portions 1*ba* is rendered to be the potion 1*ba*' with a low projection height as in FIG. 18. Broken lines in FIG. 18 shows the node portions 1*ba* that is a former state of the potion 1*ba*' before perfect circle processing. Similarly to the first embodiment (FIG. 3D), a male threaded portion 1*c* is formed over a length range where perfect circle processing has been performed in the raw material reinforcing bar W2 for thread forming (male thread rolling step).

In the case of this configuration, the reinforcing bar 1 formed with the male threaded portion 1*c* has the strip-shaped flat portions 4, but does not have a projection portion like ribs extending in the longitudinal direction. Therefore, as compared with deformed reinforcing bars with ribs that cross-section processed by thread forming, the reinforcing bar 1 has a smaller difference between the cross sections resulting from partial loss of area due to perfect circle processing and/or thread forming in portions where male threaded portions 1*c* are formed and general portions where male threaded portions 1*c* are not formed, and thus has a smaller difference in proof stress. Therefore, practically, the reinforcing bar coupling does not form a locally weak portion in the reinforcing bar. By making the diameter of the reinforcing bar larger by an amount corresponding to the cross-sectional area of the ribs, the reinforcing bar without ribs can secure proof stress equivalent to that of the reinforcing bar with the ribs. For example, the cross-sectional area of the ribs 1*bb* accounts for about 4% of the total cross-sectional area, and by making the diameter of the reinforcing bar larger by this amount, it is possible to secure proof stress equivalent to that of the reinforcing bar with the ribs.

When the male threaded portion 1*c* is a rolled thread as in the present fifth embodiment, partial loss of cross-section does not occur unlike cutting processing, and plastic flow makes a diameter of the remaining portion within the entire circumference of the reinforcing bar larger, which results in less decrease in the cross-sectional area. In addition, in the case of a rolled thread, plastic hardening occurs in the male thread rolling process to enhance proof stress. Therefore, practically, by making the reinforcing bar 1 to have a diameter that partly compensates the difference in the cross-sectional area of about 4%, it is possible to secure proof stress equivalent to that of the reinforcing bar with the ribs.

Also, even when ribs 1*bb* are formed during formation of node portions 1*ba* by pressure rolling in the manufacturing processes, strip-shaped flat portions 4 can be formed by removing the ribs 1*bb*. In this way, it is possible to manufacture a reinforcing bar 1 having a male threaded portion 1*c* from a deformed reinforcing bar as a raw material obtained by common pressure rolling. Removal of the ribs 1*bb* is achieved by scraping the ribs 1*bb* off from the intermediate reinforcing bar raw material W1 in a hot state shaped in the pressure rolling process for making the node portions 1*ba*. Therefore, a step such as cutting and the like is unnecessary, and the ribs can be easily and efficiently removed.

Figure 14A:
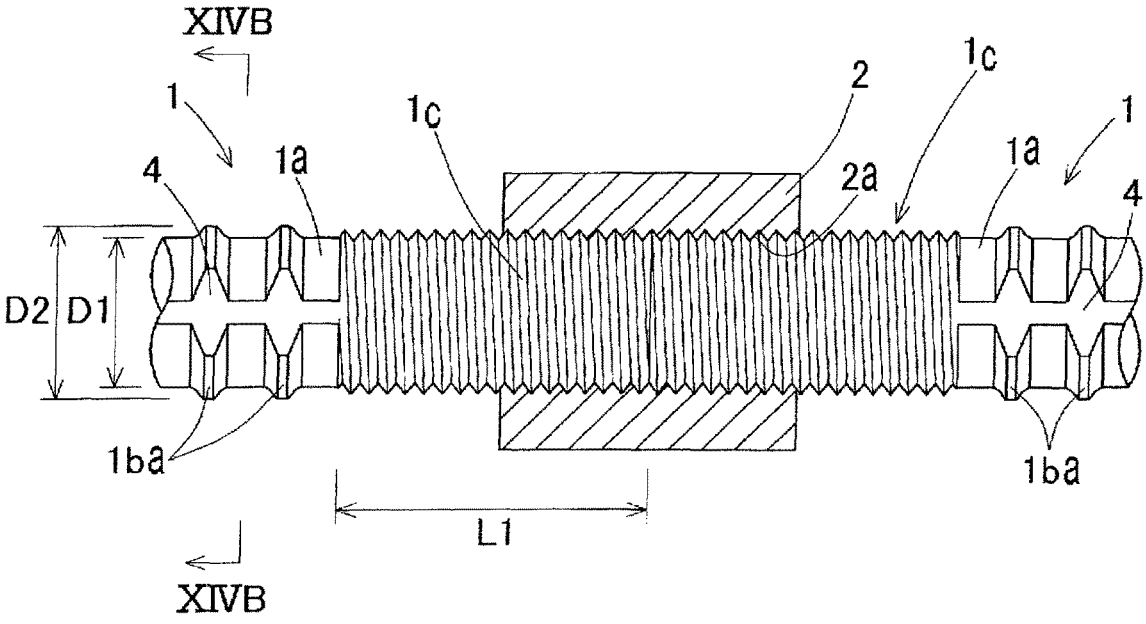
FIG. 14A is a sectional view of a threaded reinforcing bar coupling structure for a deformed reinforcing bar according to a fifth embodiment of the present invention.
Figure 14B:
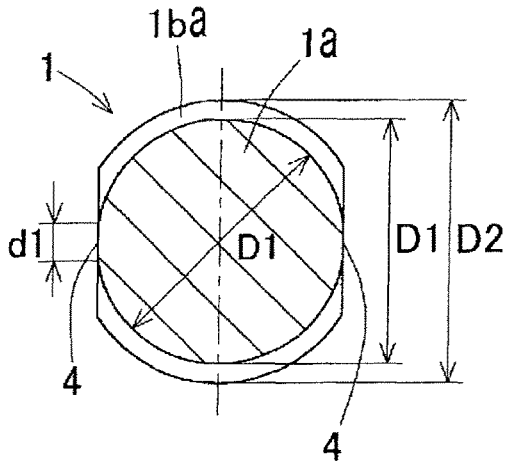
FIG. 14B is a sectional view along XIVB-XIVB line in FIG. 14A.
Figure 14C:
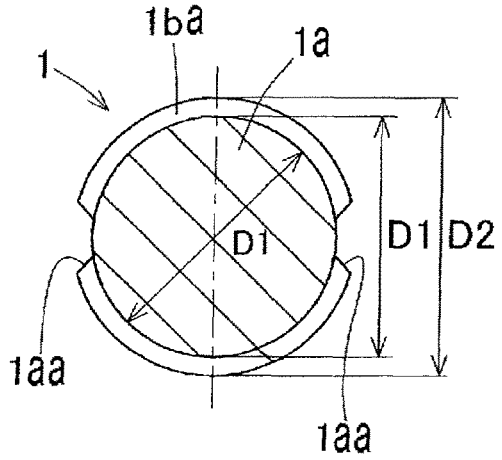
FIG. 14C is a sectional view corresponding to FIG. 14B in a variant deformed reinforcing bar.
Figure 15A:
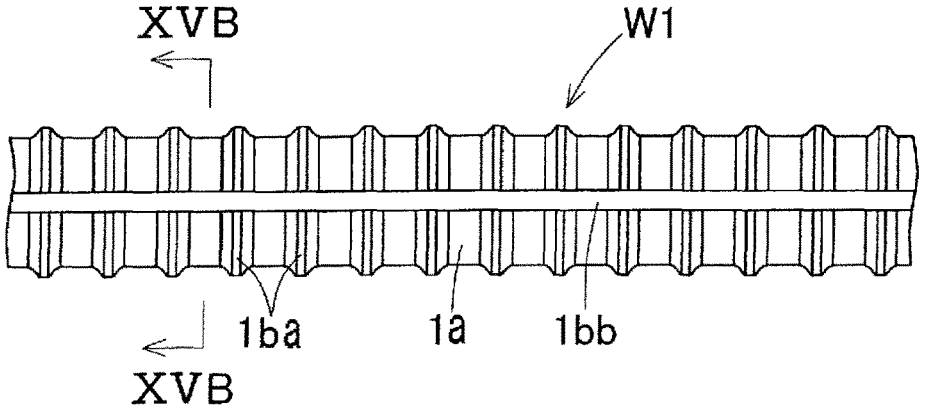
FIG. 15A illustrates a pressure rolling step in a manufacturing process of the threaded reinforcing bar coupling structure for a deformed reinforcing bar according to the fifth embodiment.
Figure 15B:
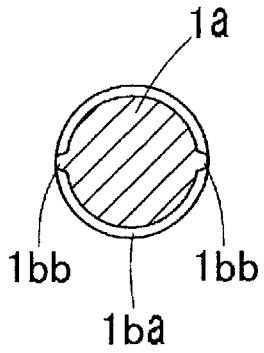
FIG. 15B is a sectional view along XVB-XVB line in FIG. 15A.
Figure 16A:
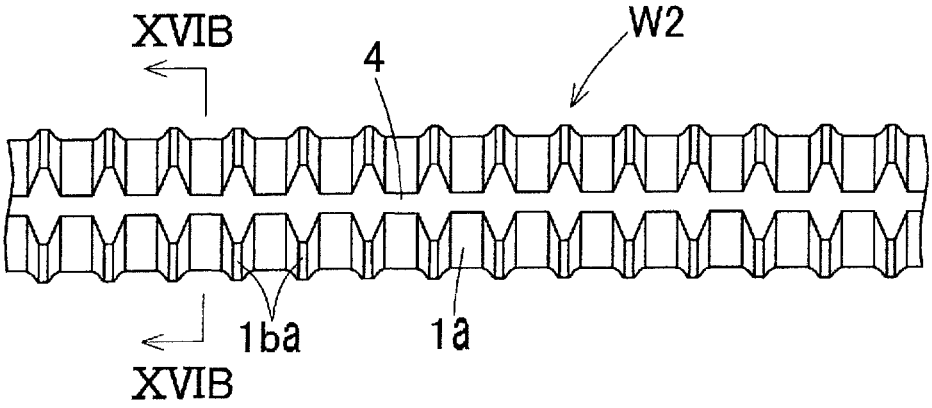
FIG. 16A illustrates a rib removing step in a manufacturing process of the threaded reinforcing bar coupling structure.
Figure 16B:
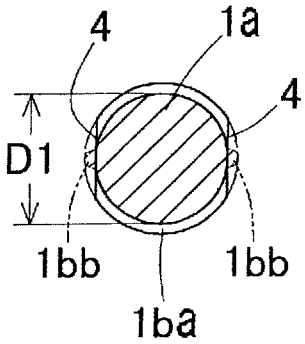
FIG. 16B is a sectional view along XVIB-XVIB line in FIG. 16A.

In the fifth embodiment, the reinforcing bar 1 is provided with the strip-shaped flat portions 4, but as shown in the sectional view of FIG. 14C, a reinforcing bar without ribs 1*bb* may simply be used. In that case, just like the fifth embodiment, it is also possible to suppress the difference in proof stress between portions where male threaded portions 1*c* are formed and general portions where male threaded portions 1*c* are not formed in the reinforcing bar 1. By removing the ribs only, that is, by eliminating the projecting portions extending along the longitudinal direction, the cross-sectional area does not change before and after rolling, and the node portions 1*ba* do not cause interference even if the node portions 1*ba* are extended. In the reinforcing bar 1 of FIG. 14C, the reinforcing bar main body 1*a* is shaped in a perfect circle over the entire circumference thereof, and the node portions 1*ba* have discontinued parts 1*baa* at two locations in the circumferential direction. When processing is performed only for removing the ribs but not for forming strip-shaped flat portions, as shown in FIG. 14C, equipment of special specification for forming the node portions 1*ba* are required, but a rib removing process can be omitted scraping ribs off.

Figure 4:
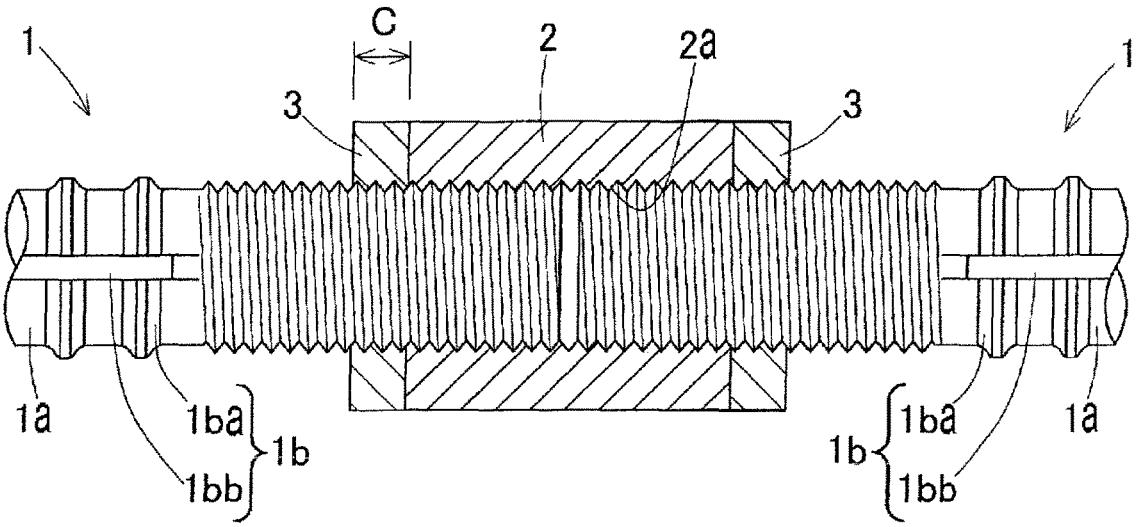
FIG. 4 is a sectional view of a threaded reinforcing bar coupling structure for a deformed reinforcing bar according to a second embodiment of the present invention.
Figure 5:
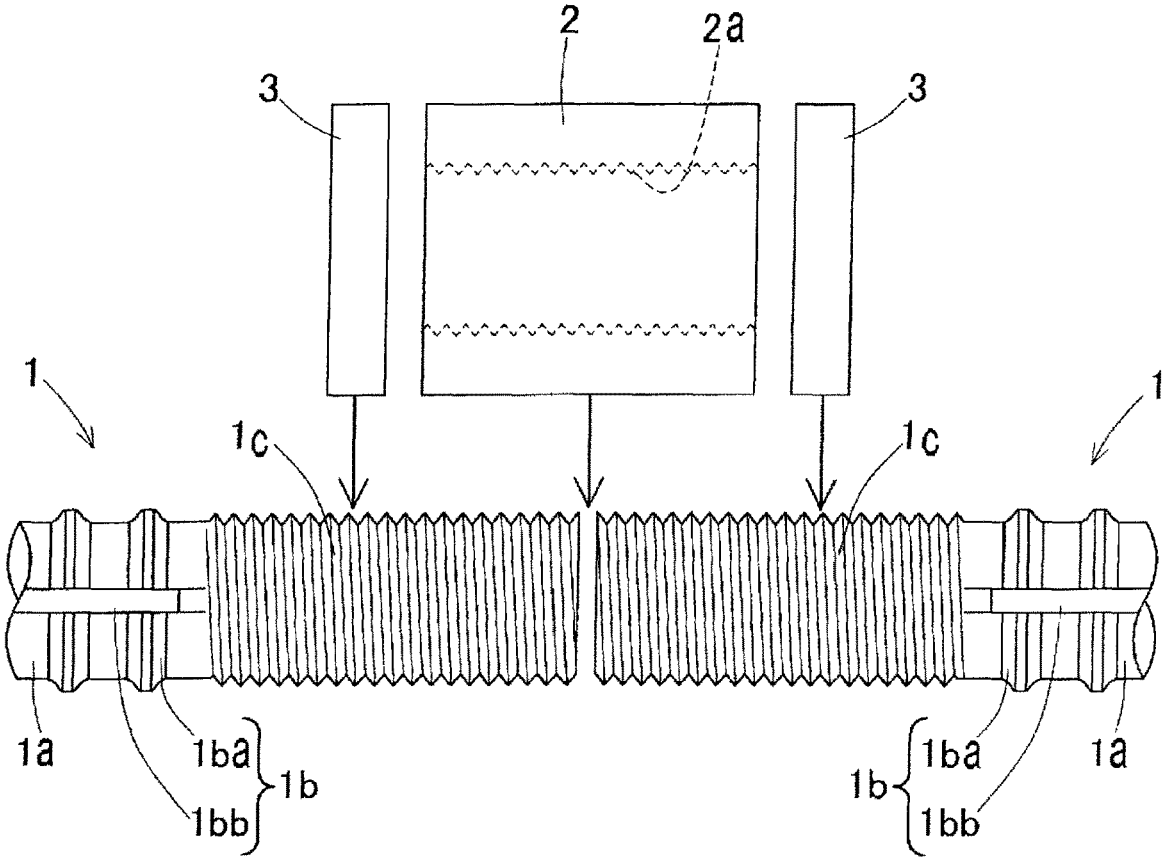
FIG. 5 is a front view of the threaded reinforcing bar coupling structure in a disassembled state.

When a reinforcing bar 1 provided with strip-shaped flat portions 4 is used, or even when a reinforcing bar simply without ribs 1*bb* as shown in FIG. 14C is used, lock nuts may be provided similarly to the second embodiment shown in FIG. 4.

Figure 20:
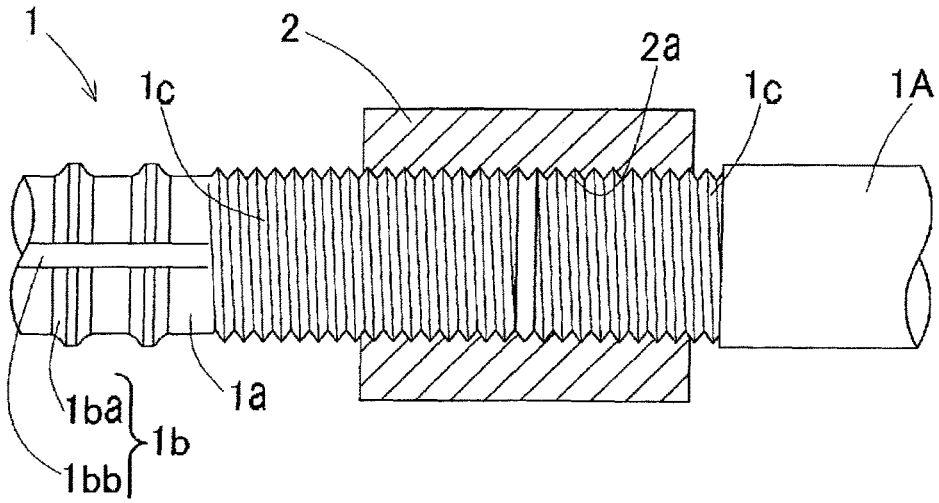
FIG. 20 is a sectional view of a threaded reinforcing bar coupling structure for a deformed reinforcing bar according to a sixth embodiment of the present invention.

In addition, although the first to fifth embodiments described above employ a configuration that the reinforcing bars 1, 1 on both sides are the same, reinforcing bars 1, 1 on both sides may have different diameters, or one of the reinforcing bars 1 may simply be a round shaft, instead of a deformed reinforcing bar, as in the sixth embodiment shown in FIG. 20. In the sixth embodiment, a reinforcing bar 1A one size larger is used. By using the reinforcing bar 1A one size larger, decrease in rigidity of the male threaded portion 1*c* can be avoided.

Figure 21:
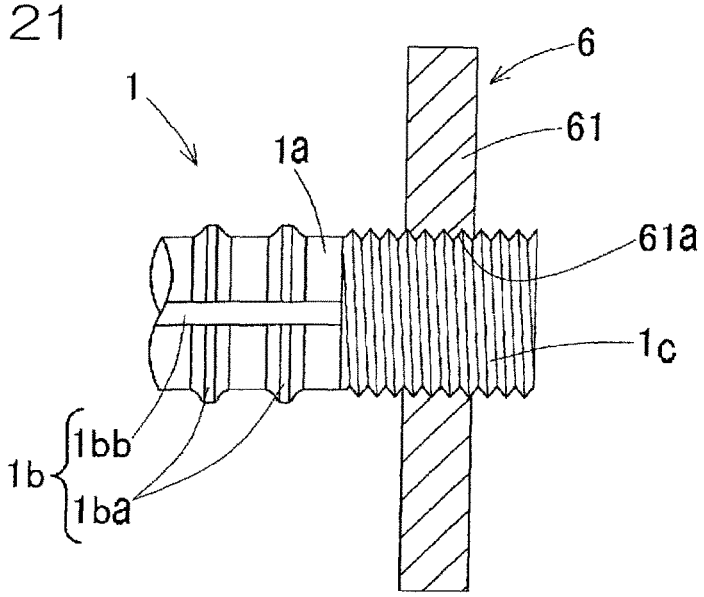
FIG. 21 is a sectional view showing an example in which an anchor plate is attached by screw coupling with the use of a reinforcing bar of the threaded reinforcing bar coupling structure.
Figure 22A:
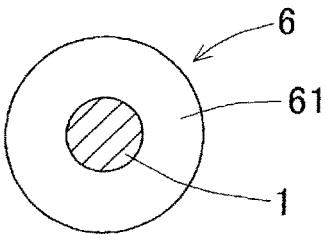
FIG. 22A is a front view of an example of the anchor plate.
Figure 22B:
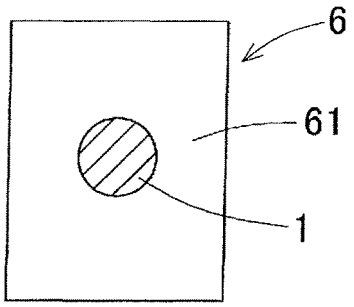
FIG. 22B is a front view of another example of the anchor plate.

FIGS. 21 to 22*b* show an example in which the male threaded portion 1*c* of the reinforcing bar 1 is provided with a diameter-enlarged head equipped part 61 via a screw hole 61*a* to form a diameter-enlarged head 6 for imparting fixing force. The male threaded portion 1*c* of the reinforcing bar 1 in FIG. 21 may be formed for a reinforcing bar coupling or formed in a short length for attaching the diameter-enlarged head equipped part 61. In addition, the reinforcing bar 1 may be connected to another reinforcing bar at one end thereof using the threaded reinforcing bar coupling structure shown in FIGS. 1A and 1B and provided with a diameter-enlarged head equipped part 61 at the other end. The diameter-enlarged head equipped part 61 is shaped like a plate having a screw hole 61*a* therein, and shape of the outer periphery thereof may be round as in FIG. 22A or rectangular as in FIG. 22B.

Generally, for example, when a reinforcing bar of concrete portion to be a beam is embedded into concrete portion to be a pillar, an end portion of the reinforcing bar 1 is often bent into a U shape or an L shape in order to obtain fixing force in the pillar. However, bar arrangement becomes complex if there are many bent portions of reinforcing bars within the pillar. Therefore, instead of a bent portion in a U shape or an L shape, a diameter-enlarged head is formed on an end portion of a reinforcing bar to secure fixing force. However, since a conventional diameter-enlarged head is manufactured by plastically deforming an end portion of a reinforcing bar in a hot state by high frequency induction and the like, process for manufacturing thereof requires equipment and labor.

To solve such a problem, it is possible to easily form a diameter-enlarged head 6 without requiring special equipment or labor by forming a diameter-enlarged head 6 by screw engaging a diameter-enlarged head equipped part 61 of FIGS. 21 to 22B. It should be noted that in the embodiment shown in FIGS. 21 to 22B, the reinforcing bar 1 may be ones shown in FIG. 7 or FIGS. 14A to 14C.

Figure 23:
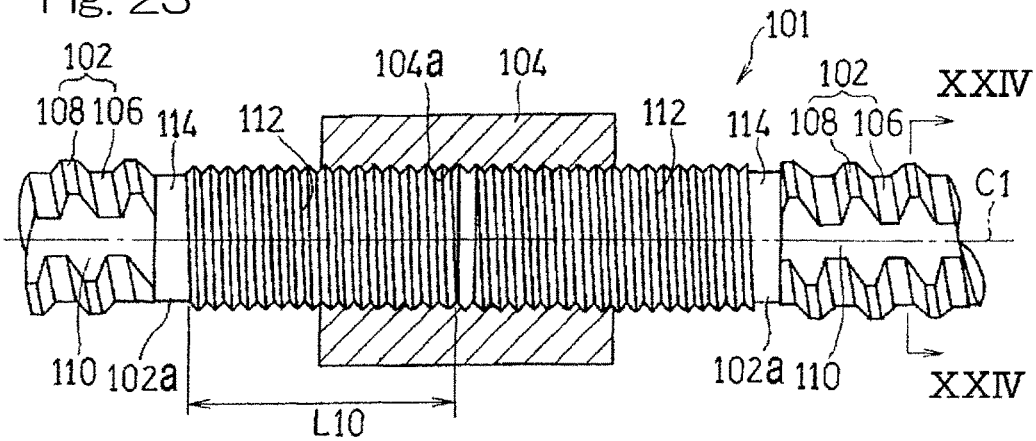
FIG. 23 is a longitudinal sectional view of a threaded reinforcing bar coupling structure for a deformed reinforcing bar according to a seventh embodiment of the present invention.

FIG. 23 is a section view of a threaded reinforcing bar coupling structure 101 for a deformed reinforcing bar according to a seventh embodiment of the present invention. The threaded reinforcing bar coupling structure 101 for a deformed reinforcing bar in FIG. 23 comprises a pair of reinforcing bars 102, 102 and a screw tubular coupler 104 connecting the pair of reinforcing bars 102, 102 with each other. Each of the reinforcing bars 102, 102 is a deformed reinforcing bar having a reinforcing bar main body 106 having a round shaft shape and spiral node portions 108 formed on an outer periphery of the reinforcing bar main body 106. In other words, the reinforcing bar 102 is a "screw node reinforcing bar" having a screw-shaped node structure. The screw node reinforcing bar is shaped by hot processing (mill roll) so that the whole reinforcing bar is shaped like a screw.

Figure 24:
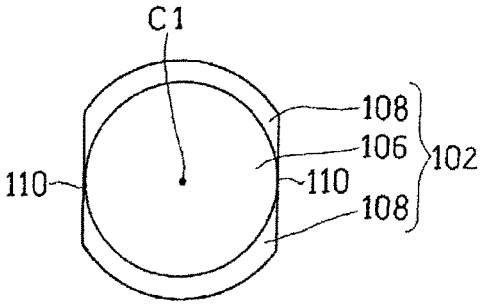
FIG. 24 is a sectional view along XXIV-XXIV line in FIG. 23.

FIG. 24 is a sectional view of the reinforcing bar 102 as viewed from a plane perpendicular to the axial direction C1 thereof. As shown in FIG. 24, straight strip-shaped flat portions 110 are formed at two locations apart from each other by 180° on the outer peripheral surface of the reinforcing bar 102. In other words, the strip-shaped flat portions 110 are straight lines in the section perpendicular to the axial direction C1. Particularly, each strip-shaped flat portion 110 is constituted of a straight line as a part of an arc of a circle forming the outer peripheral surface of the reinforcing bar main body 106. As shown in FIG. 23, the strip-shaped flat portions 110 of the present embodiment are formed on the reinforcing bar 2 over its entire axial length. The strip-shaped flat portions 110 are provided so as to generate gaps between the coupler 104 and the reinforcing bar main body 106 and to allow grout to be filled in the gaps as necessary when the pair of reinforcing bars 102, 102 are connected with each other by the coupler 104 using the node portions 108 of the screw node reinforcing bar 102.

A male threaded portion 112 is formed on one end portion 102*a* of the reinforcing bar 102. Particularly, a cylindrical portion 114 with node portions 108 removed is formed on one end portion 102*a* of the reinforcing bar 102, and the male threaded portion 112 is formed on the cylindrical portion 114. The cylindrical portion 114 is, for example, formed by cutting processing. The male threaded portion 112 in the seventh embodiment is formed by rolling. The cylindrical portion 114 of the present embodiment is a potion where a process of cutting into a perfect circle (perfect circle processing) has been performed.

The coupler 104 is screwed onto the male threaded portions 112, 112 of the respective reinforcing bars 102, 102. In other words, the respective reinforcing bars 102, 102 are connected with each other by the coupler 104 at the respective end portions 102*a*, 102*a*. The coupler 104 of the present embodiment is a screw cylinder made of steel. A female thread portion 104*a* to be screwed onto the respective male threaded portions 112, 112 is formed on the inner peripheral surface of the coupler 104. The outer peripheral surface of the coupler 104 may be a cylindrical surface or a polygonal surface, or a combination thereof. In addition, the coupler 104 may be shaped to have a flat surface on a part of the outer peripheral surface.

A length L10 of the male threaded portion 112 may be a required length for screwing into the coupler 104, but may preferably be a length that allows the entire coupler 104 to be screwed onto. In this way, during a connection operation of reinforcing bars, it is possible to screw an entire coupler 104 onto a male threaded portion 112 of a first reinforcing bar 102 of a pair of reinforcing bars 102, 102 and then screw the coupler 104 onto a male threaded portion 112 of a second reinforcing bar 102 of the pair of reinforcing bars 102, 102 by screwing the coupler 104 back after end surfaces of both reinforcing bars 102, 102 are butted against each other. Therefore, it is unnecessary to screw the reinforcing bar 102 into the coupler 104 while pulling the reinforcing bar 102, and workability on construction site is enhanced. A longitudinal sectional shape of a thread groove of the male threaded portion 112 may be triangular or trapezoidal. Also, the male threaded portions 112, 112 may be threaded in the same direction or inversely threaded to each other.

The male threaded portion 112 of the reinforcing bar 102 is a rolled thread. Particularly, the male threaded portion 112 is formed by performing rolling to the cylindrical portion 114 of the reinforcing bar 102. The male threaded portion 112 has hardness higher and tensile strength stronger than those of the remaining portion of the reinforcing bar 102 due to work hardening (plastic hardening). Hardness of the male threaded portion 112 at least on the surface portion thereof may be higher than that of the remaining portion of the reinforcing bar 102.

Figure 25:
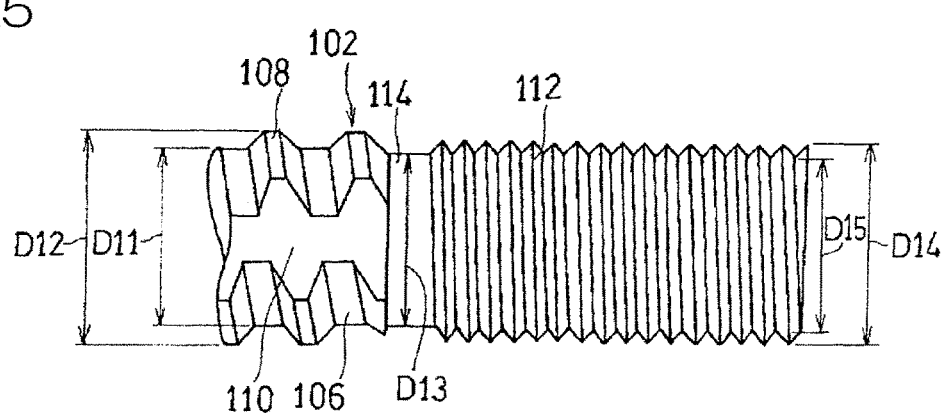
FIG. 25 is an enlarged side view of an end portion of a deformed reinforcing bar of the threaded reinforcing bar coupling structure.

With reference to FIG. 25, a relation of the dimensions of the male threaded portion 112 will be described. The reinforcing bar main body 106 has an outer diameter D11 smaller than an outer diameter (maximum diameter) D12 of the node portions 108. In the present embodiment, the outer diameter D11 of the reinforcing bar main body 106 is larger than an outer diameter D13 of the cylindrical portion 114. This is because when the cylindrical portion 114 is formed, the node portions 108 are removed while the outer peripheral surface of the reinforcing bar main body 106 is slightly cut. However, when the cylindrical portion 114 is formed, only the node portions 108 may be removed without cutting the outer peripheral surface of the reinforcing bar main body 106. In that case, the outer diameter D13 of the cylindrical portion 114 is equal to the outer diameter D11 of the reinforcing bar main body 106.

The male threaded portion 112 is formed by performing rolling to the cylindrical portion 114 of the reinforcing bar 102. Therefore, the male threaded portion 112 has a thread ridge diameter D14 larger than the outer diameter D13 of the cylindrical portion 114 and a thread groove diameter D15 smaller than the outer diameter D13 of the cylindrical portion 114.

An example of diameter dimensions of respective portions of the reinforcing bar 102 will be described. When a male threaded portion 112 with M19.8 (an outer diameter of 19.8) and a pitch of 2.5 is processed on the reinforcing bar having a nominal diameter D19, the reinforcing bar main body 106 has an outer diameter D11 of 18.00, a maximum diameter D12 of 21.50, an outer diameter D13 of the cylindrical portion 114 of 17.90, a thread ridge diameter D14 of 19.49, and a thread groove diameter D15 of 16.46 (unit: mm).

Figure 26:
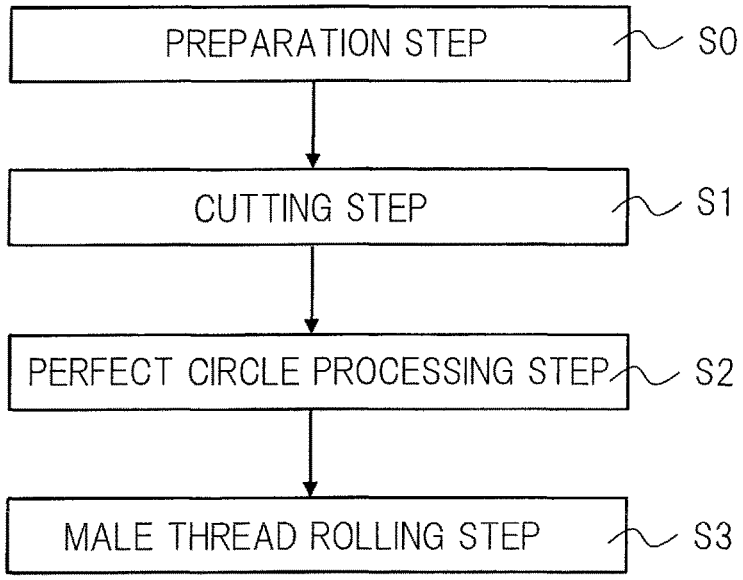
FIG. 26 is a flow diagram of a manufacturing process of the threaded reinforcing bar coupling structure.

With reference to FIG. 26, a method for manufacturing a threaded reinforcing bar coupling structure 101 for a deformed reinforcing bar according to the present embodiment will be described.

The method for manufacturing a threaded reinforcing bar coupling structure 101 for a deformed reinforcing bar of the present embodiment comprises a preparing step S0, a cutting step S1, a perfect circle processing step S2, and a male thread rolling step S3. In the preparing step S0, reinforcing bars 102 that are screw node reinforcing bars and a coupler 104 for connecting the reinforcing bars 102 are prepared.

Figure 27:
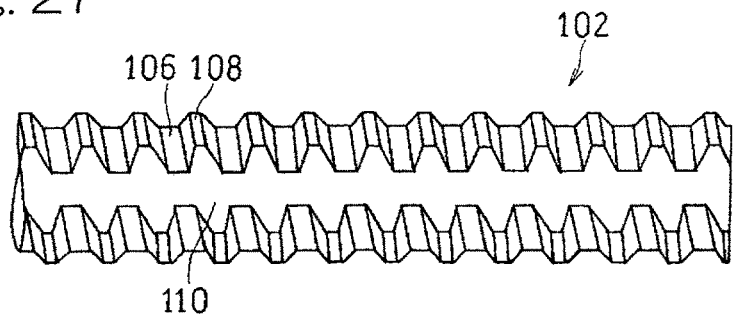
FIG. 27 is a side view of the deformed reinforcing bar.

In the cutting step S1, each deformed reinforcing bar 102 is cut into any length. Particularly, each deformed reinforcing bar 102 prepared in the preparing step S0 is cut into any length as required for a construction site or a factory and the like, as shown in FIG. 27.

Figure 28A:
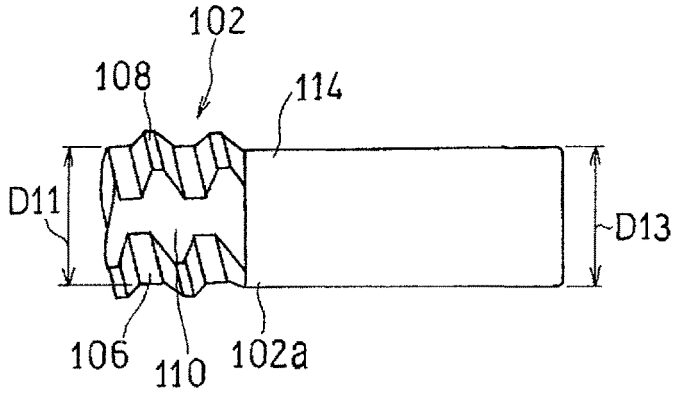
FIG. 28A is a side view showing a manufacturing process of the threaded reinforcing bar coupling structure.
Figure 28B:
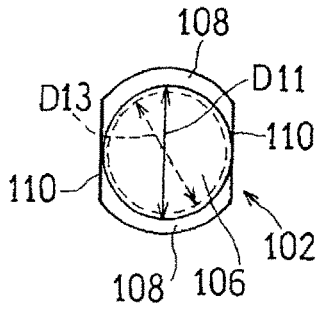
FIG. 28B is a cross-sectional view of the deformed reinforcing bar.

In the perfect circle processing step S2, perfect circle processing is performed to one end portion 102*a* of the reinforcing bar 102 cut in the cutting step S1, as shown in FIG. 28A. Perfect circle processing is performed to a portion of the one end portion 102*a* of the reinforcing bar 102 within a length range for forming a male threaded portion 112. In the perfect circle processing process, a process is performed for removing the node portions 108 as well as for cutting the reinforcing bar main body 106 into a perfect circle with an outer diameter D13, as shown in FIG. 28B. The perfect circle portion with the outer diameter D13 is rendered to be a cylindrical portion 114. However, when a cutting amount is small, flat portions 110 may be left. Even in that case, there is no problem with processing performance in the subsequent processes.

In the screw node reinforcing bar 102, as described above, strip-shaped flat portions 110 are formed so that grout can be filled in a state where the pair of reinforcing bars 102, 102 are connected with each other by a coupler using the node portions 108. In other words, the reinforcing bar 102 has an elliptical cross section. In the perfect circle processing step S2 of the present embodiment, the perfect circle portion having the outer diameter D13 is formed by cutting the outer peripheral surface of the reinforcing bar main body 106. As described in the previous embodiments, it was found from an intensive study and simulations by the Inventors that cutting does not affect performance of the reinforcing bar 102 as long as no more than 4% of the cross-sectional area of the shaft portion of the reinforcing bar 102 is cut. Therefore, performance of the reinforcing bar 102 is not affected by precutting the shaft portion of the one end portion 102*a* and performing perfect circle processing thereto within the range. In a screw node reinforcing bar, when the cross-sectional area is shaped into an ellipse instead of a perfect circle for processing convenience, performance of the reinforcing bar 102 is not affected if precutting is performed based on the longer axis of the ellipse as a reference and is set to cut no more than 4% the cross-sectional area.

It should be noted that in the present embodiment, processing is performed for removing the node portions 108 as well as for cutting the outer peripheral surface of the reinforcing bar main body 106 so that the reinforcing bar main body 106 is shaped into a perfect circle with an outer diameter D13 in the perfect circle processing step S2. However, only the node portions 108 may be removed, and precutting of the outer peripheral surface of the reinforcing bar main body 106 may be omitted. In that case, the cylindrical portion 114 has the same shape as that of the reinforcing bar main body 106. In addition, the perfect circle processing step S2 may be omitted.

In the male thread rolling step S3, a male threaded portion 112 shown in FIG. 25 is formed by rolling on the cylindrical portion 114 that has been subjected to perfect circle processing in the perfect circle processing step S2. This rolling process is performed to the one end portion 102*a* of the reinforcing bar 102 without performing a diameter-enlarging process. In the case where the perfect circle processing step S2 is omitted, a male threaded portion 112 is formed by rolling on the one end portion 102*a* of the reinforcing bar 102 that has been cut in the cutting step S1 after removing the whole or radial major portions of respective node portions 108 by machining process, without performing a diameter-enlarging process.

When the male threaded portion 112 is formed by rolling, the thread ridge diameter D14 of the male threaded portion 112 is rendered to be larger than the outer diameter D13 of the cylindrical portion 114, due to composition flow. The rolling process is performed using rolling dies (not shown) in a cold, warm, or hot state. The rolling process is, for example, so-called three-point rolling process, in which thread forming is performed at three points.

By rolling the male threaded portion 112 in this way, the male threaded portion 112 is hardened by work hardening. In addition, the thread groove diameter D15 of the male threaded portion 112 is rendered to be smaller than the outer diameter D11 of the reinforcing bar main body 106 and the outer diameter D13 of the cylindrical portion 114. A length of the male threaded portion 112 to be processed by perfect circle processing and rolling may be set to be long for adjustment of the length, so that the male threaded portion 112 can be cut according to places for use at a construction site of bar arrangement. Thus, construction performance is enhanced.

In to the above configuration, since the male threaded portion 112 is formed by rolling, the screw pitch can be made small. Thus, a length of the coupler 104 can be made short. In addition, grout filling is unnecessary, since adhesion of contact surfaces of the screws can be secured. As a result, it is possible to omit the grout filling process and steps such as quality management of grout at a construction site, and further a curing period required for hardening of grout is not necessary. Therefore, it is possible to prevent increase in operation steps and a work period at a construction site.

Further, the thread groove diameter D15 of the male threaded portion 112 is smaller than the outer diameter D13 of the cylindrical portion 114, and the thread ridge diameter D14 of the male threaded portion 112 is larger than the outer diameter D13 of the cylindrical portion 114. Therefore, it is possible to form the male threaded portion 112 without preprocessing a raw material deformed reinforcing bar 102 or only with preprocessing by perfect circle processing. The male threaded portion 112 can be formed by performing thread forming to the deformed reinforcing bar 102, without performing large scale preprocessing, such as diameter enlargement, and thus, is excellent in productivity. Although decrease in proof stress of the reinforcing bar 102 in the coupling portion is concerned because the thread groove diameter D15 of the male threaded portion 112 is smaller than the outer diameter D11 of the reinforcing bar main body 106, sufficient proof stress can be achieved because hardness of the male threaded portion 112 is greater than that of the remaining portion.

Hardness required for compensating the decrease in proof stress of the male threaded portion 112 due to decrease in the cross-sectional area of the shaft portion as a result of precutting can be sufficiently obtained from work hardening by rolling the male threaded portion 112. In other words, hardness required for the male threaded portion 112 can also be obtained by simply rolling the male threaded portion 112 on the deformed reinforcing bar 102. Accordingly, a process for enhancing proof stress of the male threaded portion 112 is not required, which contributes to excellent productivity. If the couplers 104 are prepared on a construction site, work that is left is merely to cut the deformed reinforcing bar 102 (cutting step) and to roll the male threaded portion 112 (male thread rolling step), and thus, can be performed at a construction site.

In a screw node reinforcing bar, strip-shaped flat portions 110 are formed so as to be able to fill grout. In other words, the screw node reinforcing bar has an elliptical cross section. According to the above configuration, grout filling is unnecessary, and thus, the strip-shaped flat portions 110 may be omitted. Therefore, as shown in FIG. 28B, in the perfect circle processing step S2, perfect circle processing is performed to a region of the one end portion 102*a* of the reinforcing bar 102 where a male threaded portion 112 is to be formed, and a cylindrical portion 114 having the outer diameter D13 is formed. By forming a male threaded portion 112 on the cylindrical portion 114 which is a perfect circle portion, it is possible to obtain the male threaded portion 112 having excellent proof stress. It should be noted that as stated above, cutting does not affect performance of the reinforcing bar 102 as long as no more than 4% of the cross-sectional area of the shaft portion of the reinforcing bar 102 is cut.

Figure 29:
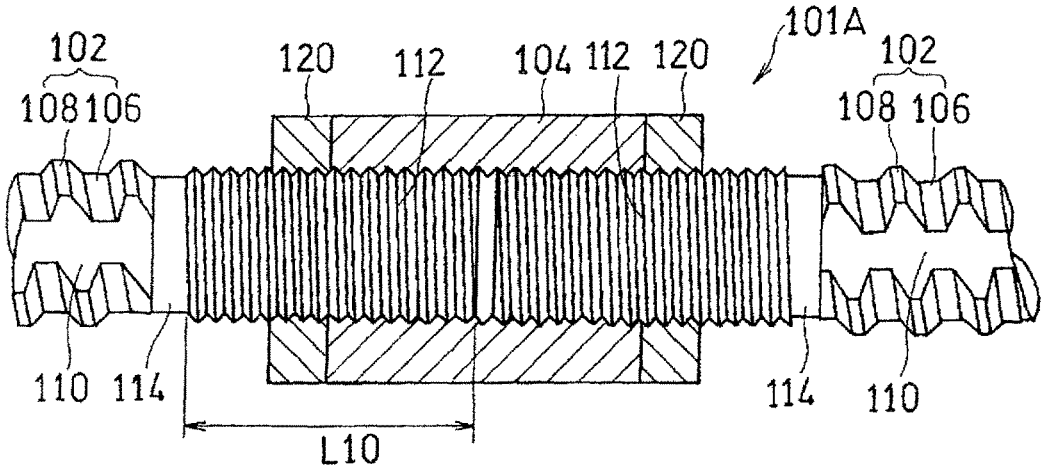
FIG. 29 is a longitudinal sectional view of a threaded reinforcing bar coupling structure for a deformed reinforcing bar according to an eighth embodiment of the present invention.

FIG. 29 shows a threaded reinforcing bar coupling structure 101A for a deformed reinforcing bar according to an eighth embodiment of the present invention. In the eighth embodiment, the same reference signs are provided for the same elements as in the seventh embodiment, and description thereof is omitted. The threaded reinforcing bar coupling structure 101A for a deformed reinforcing bar of the eighth embodiment differs from the threaded reinforcing bar coupling structure 101 of the seventh embodiment in that it is provided with a pair of lock nuts 120, 120.

The lock nuts 120 are screwed onto the male threaded portions 112 and abutted with the end surfaces of a coupler 104. A lock nut 120 may be provided so as to be abutted with one of the end surfaces of the coupler 104. The outer peripheral surface of the lock nut 120 may be round or polygonal. In the present embodiment, a length L10 of the male threaded portion 112 may be a length that allows the lock nuts 120 and the coupler 104 in their entirety to be temporarily screwed onto a male threaded portion 112 on one side. The eighth embodiment has the same configuration as the seventh embodiment otherwise.

The eighth embodiment has the same effect as the seventh embodiment. Further, according to the eighth embodiment, the lock nuts 120 prevent backlash between the reinforcing bar 102 and the coupler 104. In addition, transmission of tensile force and compression force in the threaded reinforcing bar coupling structure 101A of the present embodiment is achieved in a same manner as described above with reference to FIGS. 6A and 6B. Therefore, the contact surfaces of the respective thread ridges of the male threaded portion 112 and of the female thread portion 104*a* of the coupler 104 are not changed when tensile force acts and when compression force acts, satisfying both requirements for tensile proof stress and compression proof stress.

Figure 30:
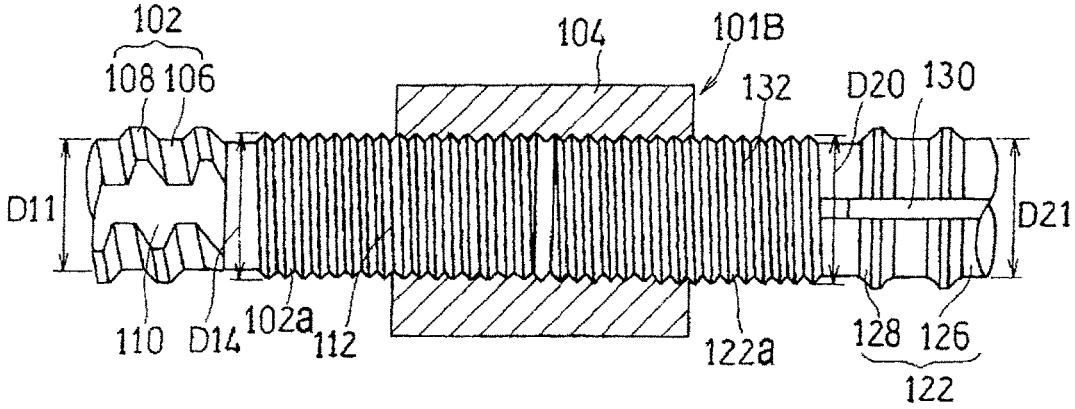
FIG. 30 is a longitudinal sectional view of a threaded reinforcing bar coupling structure for a deformed reinforcing bar according to a ninth embodiment of the present invention.

FIG. 30 shows a threaded reinforcing bar coupling structure 101B for a deformed reinforcing bar according to a ninth embodiment of the present invention. In the seventh and eighth embodiments, both reinforcing bars of a pair of reinforcing bars 102, 102 are screw node reinforcing bars, while in the ninth embodiment, a first reinforcing bar of a pair of reinforcing bars 102, 102 is a screw node reinforcing bar 102, and a second reinforcing bar of the pair of reinforcing bars 102, 102 is a bamboo node reinforcing bar 122. The bamboo node reinforcing bar 122 also has a reinforcing bar main body 126 having a round shaft shape and annular node portions 128 provided on the outer periphery of the reinforcing bar main body 126. Node portions 128 of the bamboo node reinforcing bar 122 are provided only for enhancing adhesion performance and do not have a screw-shaped node structure. A plurality of node portions 128 of the bamboo node reinforcing bar 122 in FIG. 30 are formed at an interval in a longitudinal direction of the reinforcing bar main body 126.

The bamboo node reinforcing bar 122 further has ribs 130 on the outer periphery of the reinforcing bar main body 126. The ribs 130 are constituted of projections extending in the longitudinal direction of the reinforcing bar main body 126. The radial projection height of the ribs 130 is substantially equal to the radial projection height of the node portions 128. The ribs 130 are formed at two locations radially apart from each other by 180° on the outer peripheral surface of the reinforcing bar main body 126. A male threaded portion 132 is formed by rolling on one end portion 122*a* of the bamboo node reinforcing bar 122.

As described in the previous embodiments, the ribs 130 account for about 4% of the total cross-sectional area in the bamboo node reinforcing bar 122. By forming the male threaded portion 132 on the one end portion 122*a* of the bamboo node reinforcing bar 122, not only the node portions 128 of the one end portion 122*a* but also the ribs 130 of the one end portion 122*a* are removed. This results in a loss of 4% in the total cross-sectional area, and accordingly, cutting the reinforcing bar main body 126 is not preferable because it may have an influence on performance of the reinforcing bar 122. Therefore, in the bamboo node reinforcing bar 122, the male threaded portion 132 has the thread ridge diameter D20 larger than the outer diameter D21 of the reinforcing bar main body 126.

The screw node reinforcing bar 102 does not have ribs extending in the longitudinal direction. Accordingly, in the screw node reinforcing bar 102, cutting the reinforcing bar main body 106 to form a male threaded portion 112 thereon does not affect performance of the reinforcing bar 102 as long as no more than 4% of the cross-sectional area of the shaft portion of the reinforcing bar is cut, as described above However, when the screw node reinforcing bar 102 and the bamboo node reinforcing bar 122 are connected with each other by the coupler 104 as in the ninth embodiment, the thread ridge diameter D14 of the male threaded portion 112 is set to be larger than the outer diameter of the reinforcing bar main body 106 in order to secure compatibility. When the screw node reinforcing bar 102 and the bamboo node reinforcing bar 122 are connected with each other, a compatible coupler can be made by rolling the male threaded portions 112, 132 so as to have the thread ridge diameters D14, D20 so that they satisfy following formula (1) (unit: mm).

$$D11-(0.0 \text{ to } 0.25)=D21+(0.05 \text{ to } 0.20) \quad (1)$$

Figure 31:
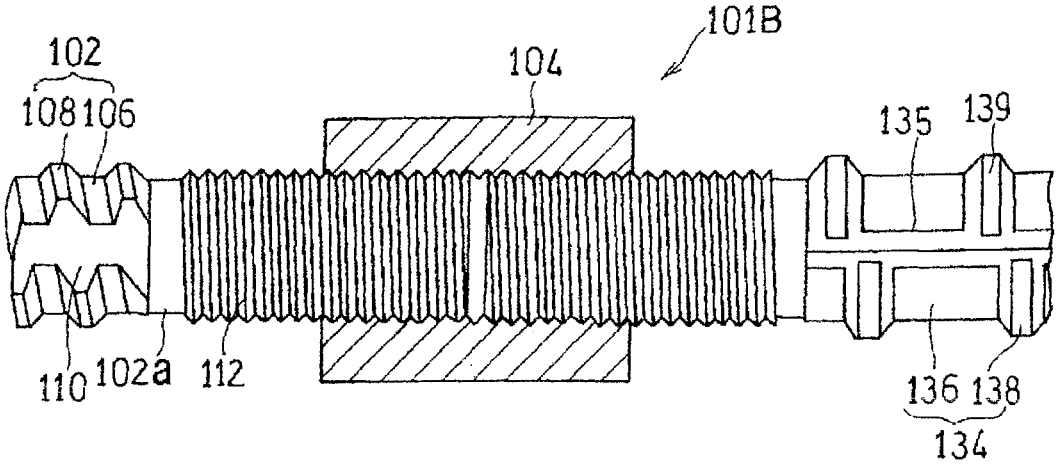
FIG. 31 is a longitudinal sectional view of a variant of the threaded reinforcing bar coupling structure.

In a variant shown in FIG. 31, a first reinforcing bar of a pair of reinforcing bars 102, 134 is a screw node reinforcing bar 102, and a second reinforcing bar of the pair of reinforcing bars 102, 134 is a deformed reinforcing bar 134 with ribs 135. The deformed reinforcing bar 134 also has a reinforcing bar main body 136 having a round shaft shape and node portions 138, 139 provided on an outer periphery of the reinforcing bar main body 136. The ribs 135 are formed at two locations apart from each other by 180° on the outer peripheral surface of the reinforcing bar main body 136. Also, the node portions 138, 139 of the deformed reinforcing bar 134 are provided only for enhancing adhesion performance and do not have a screw-shaped node structure. The node portions 138, 139 of the deformed reinforcing bar 134 in FIG. 31 are formed in a semi-circular shape between the two ribs 135 constituted of the projections extending in the longitudinal direction, and both node portions 138, 139 are shifted from each other in the longitudinal direction of the deformed reinforcing bar 134.

Figure 32:
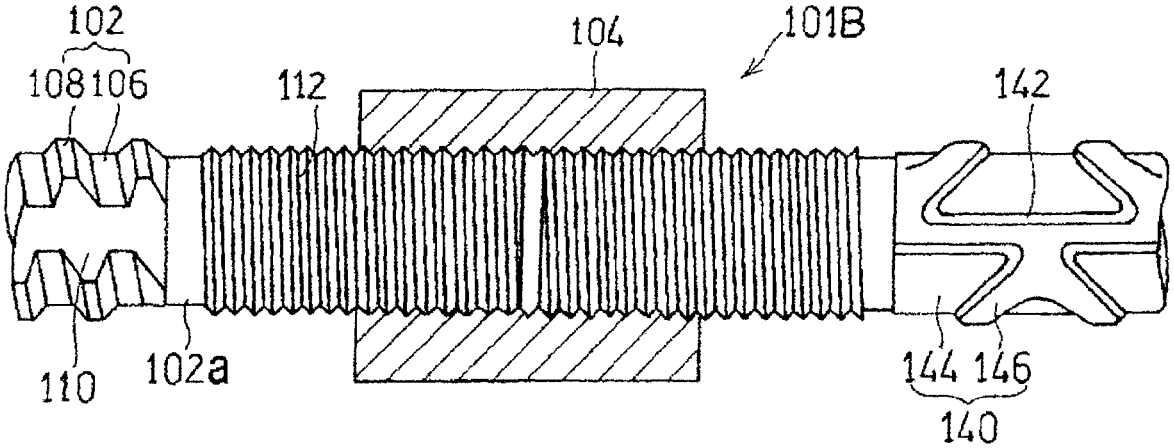
FIG. 32 is a longitudinal sectional view of another variant of the threaded reinforcing bar coupling structure.

Also in another variant shown in FIG. 32, a first reinforcing bar of a pair of reinforcing bars 102, 140 is a screw node reinforcing bar 102, and a second reinforcing bar of the pair of reinforcing bars 102, 140 is a deformed reinforcing bar 140 with ribs 142. The deformed reinforcing bar 140 also has a reinforcing bar main body 144 having a round shaft shape and node portions 146 provided on an outer periphery of the reinforcing bar main body 144. The ribs 142 are formed at two locations apart from each other by 180° on the outer peripheral surface of the reinforcing bar main body 144. Also, the node portions 146 of the deformed reinforcing bar 140 are provided only for enhancing adhesion performance and do not have a screw-shaped node structure. The deformed reinforcing bar 140 in FIG. 32 has net-like or meshed node portions 146 formed between two ribs 142 extending in the longitudinal direction.

As in the examples in FIGS. 30 to 32, the threaded reinforcing bar coupling structure of the present invention may be applied for connecting a screw node reinforcing bar 102 and a deformed reinforcing bar with ribs with each other.

Figure 33:
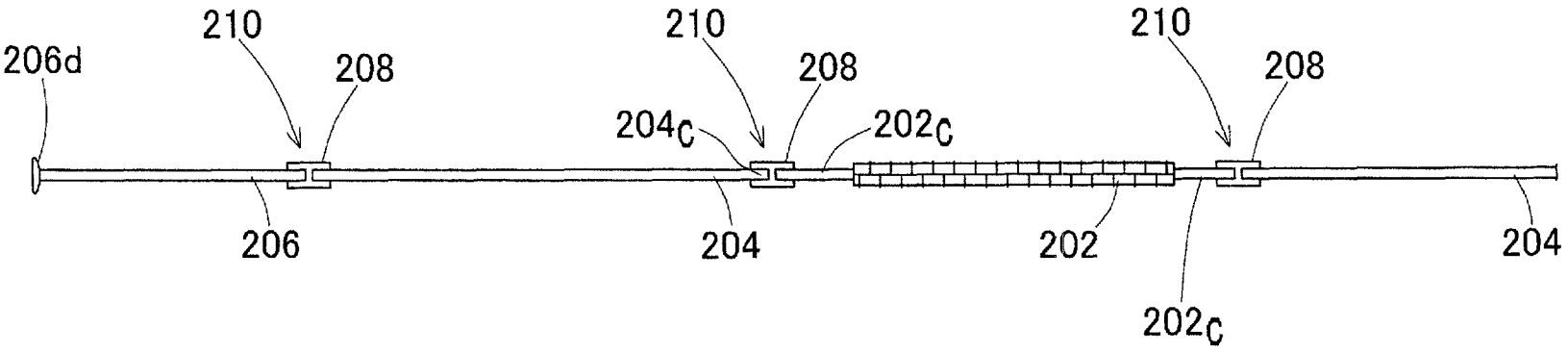
FIG. 33 is a schematic cutaway front view of a bar arrangement structure in which a threaded reinforcing bar coupling structure according to a tenth embodiment of the present invention is used.

A tenth embodiment of the present invention will be described with reference to FIGS. 33 to 38. The bar arrangement structure of the tenth embodiment is a bar arrangement structure in which a threaded reinforcing bar coupling structure of the first embodiment is used. Particularly, as shown in FIG. 33, a plurality of reinforcing bars 202, 204, 206 arranged in a length direction thereof are connected by a threaded reinforcing bar coupling structure 210 including a coupler 208.

Particularly, in the bar arrangement structure of the tenth embodiment, a single length adjusting reinforcing bar 202 and a plurality of standard length reinforcing bars 204, 206 are used. The standard length reinforcing bars 204, 206 include a middle standard length reinforcing bar 204 and an end standard length reinforcing bar 206.

Figure 34A:
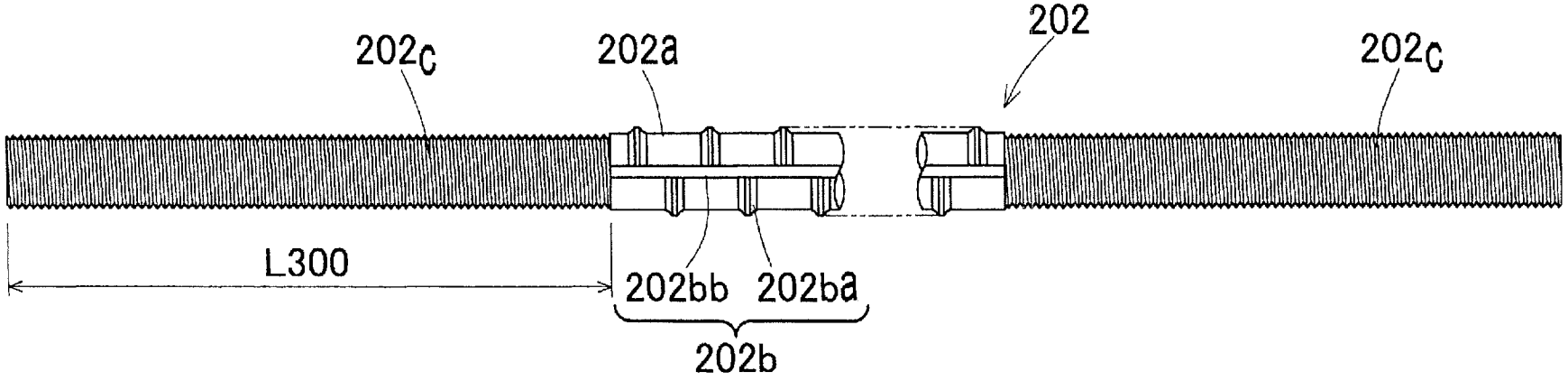
FIG. 34A is a front view of a length adjusting reinforcing bar used for the bar arrangement structure in which an intermediate portion thereof is omitted.
Figure 34B:
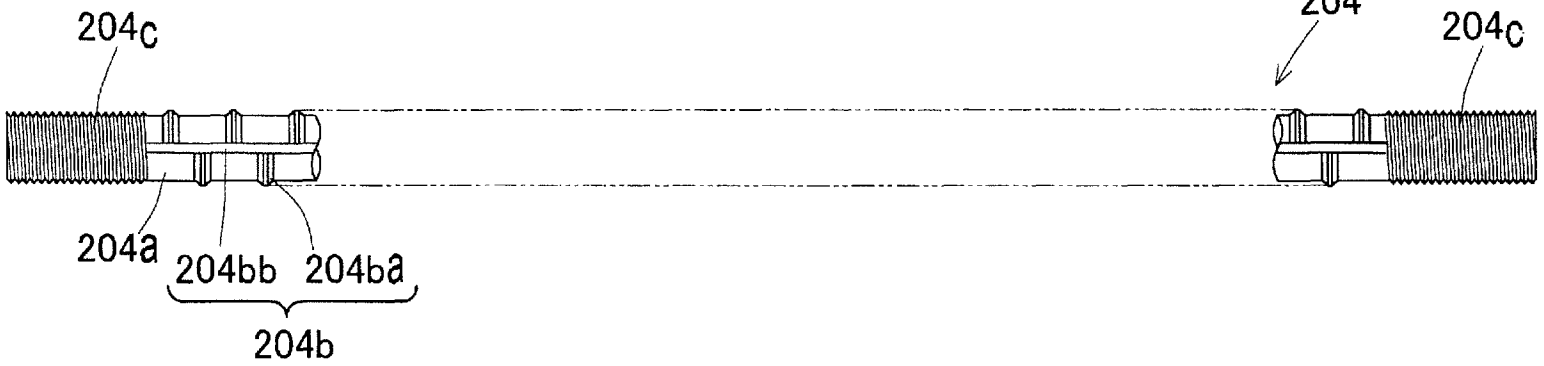
FIG. 34B a front view of a standard length reinforcing bar in an intermediate location used for the bar arrangement structure in which an intermediate portion thereof is omitted.
Figure 34C:
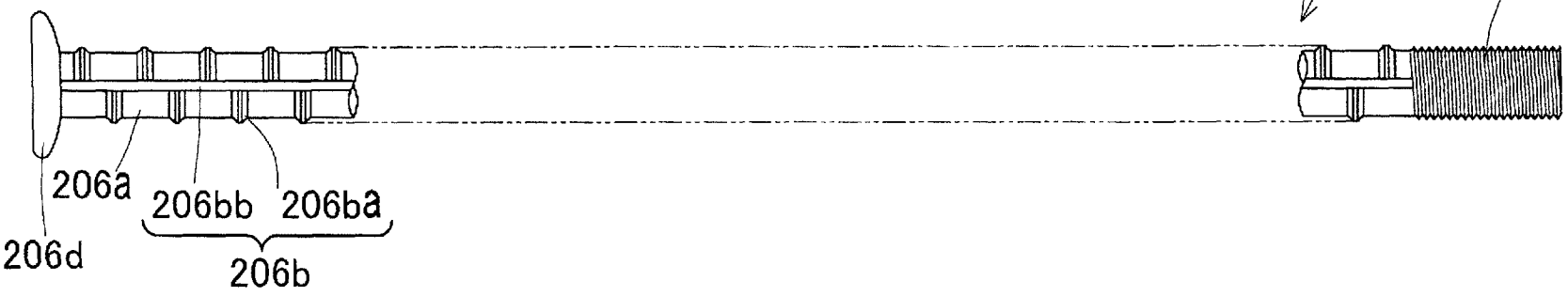
FIG. 34C a front view of a standard length reinforcing bar at an end used for the bar arrangement structure in which an intermediate portion thereof is omitted.
Figure 34D:
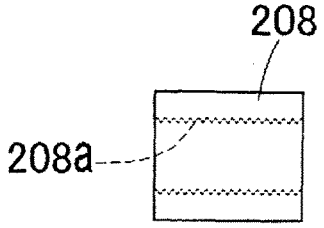
FIG. 34D is a front view of a coupler used for the bar arrangement structure.

The respective reinforcing bars 202, 204, 206 are deformed reinforcing bars which includes reinforcing bar main bodies 202*a*, 204*a*, 206*a* and projections 202*b*, 204*b*, 206*b* on the outer peripheries of the reinforcing bar main bodies 202*a*, 204*a*, 206*a*, respectively, as shown in FIGS. 34A to 34C. In addition, male threaded portions 202*c*, 204*c*, 206*c* are formed on end portions of the reinforcing bars 202, 204, 206, respectively. As shown in FIG. 34D, a coupler 208 is a screw cylinder with a female thread portion 208*a* in its inner periphery thereof. The male threaded portions 202*c*, 204*c*, 206*c* and the couplers 208 constitute a part of the threaded reinforcing bar coupling structure 210 (FIG. 33).

In the illustrated example, the projections 202*b*, 204*b*, 206*b* of the respective reinforcing bars 202, 204, 206 are constituted of the node portions 202*ba*, 204*ba*, 206*ba* arranged alternately in every half circumference and two ribs 202*bb*, 204*bb*, 206*bb* extending in the length direction at locations circumferentially apart from each other by 180°. However, the node portions 202*ba*, 204*ba*, 206*ba* may be shaped so as to extend along the entire circumference or may be a projection that spirally extends.

Figure 36:
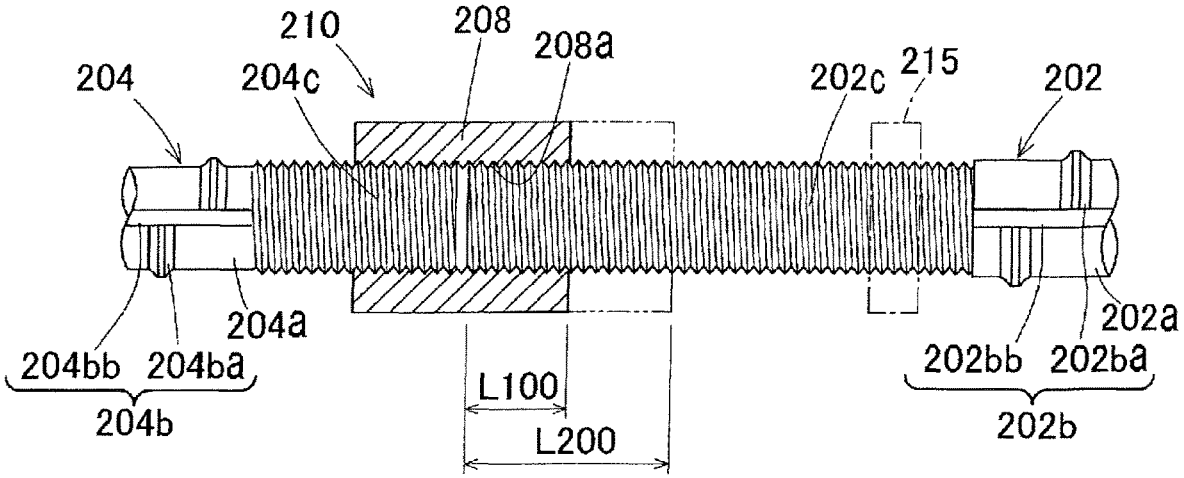
FIG. 36 is a sectional view of a threaded reinforcing bar coupling structure in the bar arrangement structure.

The male threaded portion 204*c* of the middle standard length reinforcing bar 204 and the male threaded portion 206*c* of the end standard length reinforcing bar 206 are formed over a certain length for use in a threaded reinforcing bar coupling, as shown in FIGS. 34B and 34C. The "certain length used in a threaded reinforcing bar coupling" means any length set within a range between a minimum length L100 to be screwed into a coupler 208 in a use state of the reinforcing bar coupling structure 210 as shown in FIG. 36 and a maximum length L200 that allows the entire coupler 208 to be screwed so that the coupler 208 can be temporary kept during a coupler connection operation (in the present example, it is equivalent to the length of the coupler 208). The maximum length L200 may have an appropriate margin.

As shown in FIG. 34B, male threaded portions 204*c* are formed on both ends of the middle standard length reinforcing bar 204. The end standard length reinforcing bar 206 is a reinforcing bars used for opposite ends of the bar arrangement structure. The end standard length reinforcing bar 206 has a male threaded portion 206*c* formed only on one end thereof and a diameter-enlarged head 206*d* formed on the other end thereof, as shown in FIG. 34C. The diameter-enlarged head 206*d* is a portion for fixing to concrete. The diameter-enlarged head 206*d* of the reinforcing bar is, for example, used in such a way that the diameter-enlarged head 206*d* is located in a pillar when the bar arrangement structure is used as a main reinforcement in a beam in a reinforced concrete building. Manufacturing of a diameter-enlarged head 206*d* is, for example, performed by imparting compression force while heating a raw material deformed reinforcing bar by induction heating.

Instead of using the end standard length reinforcing bar 206, for example, the middle standard length reinforcing bar 204 may be used, in which case a diameter-enlarged head 206*d* may be formed by attaching the diameter-enlarged head equipped part 61 as described above and shown in FIG. 21 to the male threaded portion 204*c*.

As shown in FIG. 34A, the male threaded portions 202*c* on both ends of the length adjusting reinforcing bar 202 are formed so as to be longer than the male threaded portions 204*c*, 206*c* of the standard length reinforcing bars 204, 206. The male threaded portion 202*c* of the length adjusting reinforcing bar 202 is used for adjustment of the length of the bar arrangement structure. In other words, the male threaded portion 202*c* of the length adjusting reinforcing bar 202 is cut into any length and used for connection to the coupler 208. In the present embodiment, a deformed reinforcing bar having a reinforcing bar diameter one rank higher than those of the standard length reinforcing bars 204, 206 is used as the length adjusting reinforcing bar 202. For example, when the standard length reinforcing bars 204, 206 are deformed reinforcing bars of D22, a deformed reinforcing bar of D25 is used as the length adjusting reinforcing bar 202. Use of a deformed reinforcing bar having a diameter one rank higher allows thread forming of the male threaded portion 202*c* of the length adjusting reinforcing bar 202 to be performed by cutting processing, while disregarding a problem of diameter decrease due to thread forming.

With respect to the standard length reinforcing bars 204, 206, the male threaded portions 204*c*, 206*c* are formed by rolling in order to secure diameters of the male threaded portions 204*c*, 206*c*. The diameters of respective portions are in the relation previously described with reference to FIG. 1B. In addition, the male threaded portions 204*c*, 206*c* of the standard length reinforcing bars 204, 206 are formed through the processing steps previously described with reference to FIGS. 3A to 3D. The elongated male threaded portion 202*c* of the length adjusting reinforcing bar 202 has the same diameter as that of each of the male threaded portions 204*c*, 206*c* of the standard length reinforcing bars 204, 206.

Figure 35A:
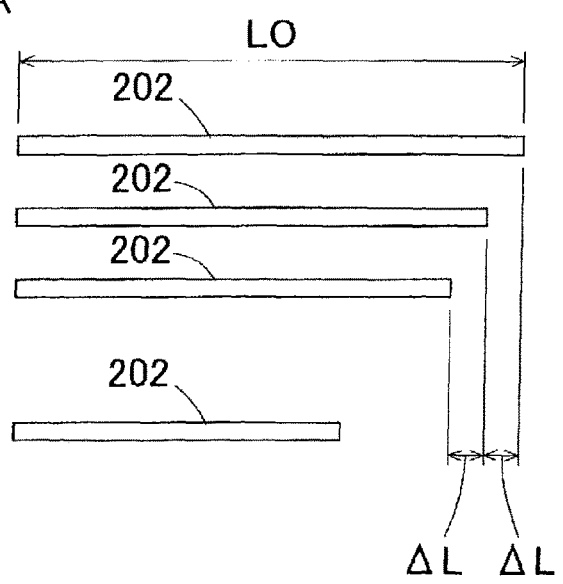
FIG. 35A illustrates a group of length adjusting reinforcing bars prepared as reinforcing bars used for the bar arrangement structure.
Figure 35B:
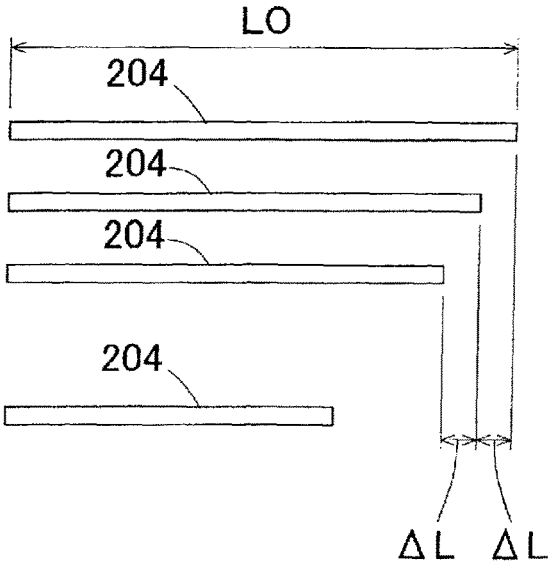
FIG. 35B illustrates a group of standard length reinforcing bars prepared as reinforcing bars used for the bar arrangement structure.

As the standard length reinforcing bars 204, 206 and the length adjusting reinforcing bar 202, for example, several types (about 3 to 6 types) of reinforcing bars having standardized entire lengths are prepared as shown in FIGS. 35A, 35B. Reinforcing bars with arbitrary lengths are selected or combined to be used. The entire length L0 of the standard length reinforcing bars 204, 206 and the length adjusting reinforcing bar 202 is standardized to provide multiple types of reinforcing bars with a certain entire length difference ΔL of about 0.5 m (for example, reinforcing bars of 5 m, 5.5 m, 6 m, etc.).

A length L300 (FIG. 34A) of the elongated male threaded portion 202*c* of the length adjusting reinforcing bar 202 may be any length, but it is not preferable to make the length L300 unnecessarily long because fixing force to concrete decreases at the elongated male threaded portion 202*c*. Therefore, the length L300 may be, for example, a sum of half of the certain entire length difference ΔL and a length required for screwing into the coupler 208.

The elongated male threaded portion 202*c* of the length adjusting reinforcing bar 202 may be attached with an attachment metal fitting 215 as shown with a single dotted line in FIG. 36. The attachment metal fitting 215 is a nut-like metal member having a female thread portion to be screwed onto the long male threaded portion 202*c* on an inner periphery thereof. In the case where the male threaded portion 202*c* is elongated, fixing force to concrete decreases, but the fixing force can be compensated by providing the attachment metal fitting 215. The attachment metal fitting 215 may be attached when the length adjusting reinforcing bar 202 is used without cutting it short and may be unattached when the reinforcing bar is cut short to a certain degree.

Figure 37A:
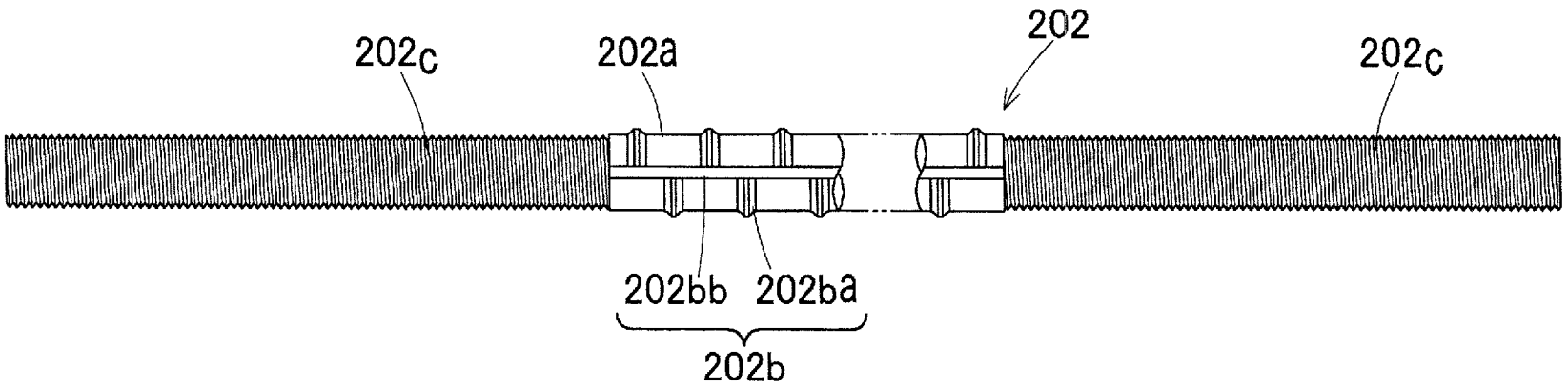
FIG. 37A illustrates a preparing step of the length adjusting reinforcing bar.
Figure 37B:
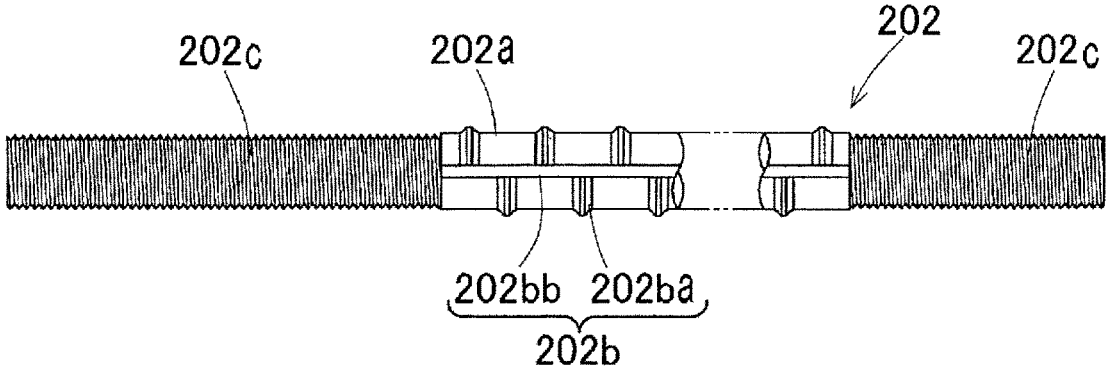
FIG. 37B illustrates a cutting step of the length adjusting reinforcing bar.
Figure 37C:
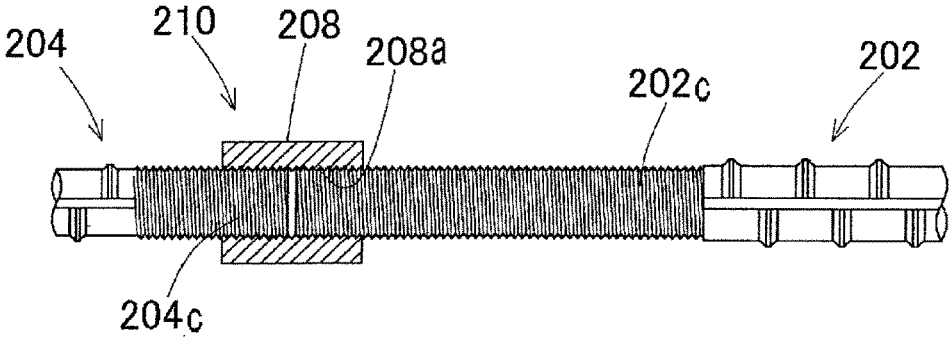
FIG. 37C illustrates a coupling connection step of the length adjusting reinforcing bar.

With reference to FIGS. 37A to 37C, steps from cutting of a length adjusting reinforcing bar 202 to coupler connection will be described.

As shown in FIG. 37A, a length adjusting reinforcing bar 202 having elongated male threaded portions 202*c*, 202*c* on both ends thereof is prepared. As shown in FIG. 37B, the male threaded portions 202*c*, 202*c* on both ends of the length adjusting reinforcing bar 202 are cut into a required length. As shown in FIG. 37C, the length adjusting reinforcing bar 202 and a standard length reinforcing bar 204 are connected with each other by a coupler 208.

In this configuration, the length adjusting reinforcing bar 202 has the elongated male threaded portion 202*c*, and by cutting the male threaded portion 202*c* into an arbitrary length, it can be used as a male threaded portion 202*c* of the threaded reinforcing bar coupling structure 210. In this way, it is possible to adjust the entire length of the length adjusting reinforcing bar 202. Therefore, it is possible to arbitrarily adjust the overall length of the bar arrangement, even if other reinforcing bars 204, 206 are of a standard length.

Although it is possible to form bar arrangements of different overall lengths by preparing multiple type of having different entire length differences ΔL as the standard length reinforcing bars 204, 206 and combining these reinforcing bars, combinations of them cannot produce a length that is intermediate of the entire length difference ΔL. The bar arrangement structure having this configuration allows bar arrangement of such an overall length to be achieved. Therefore, it is not necessary to use reinforcing bars with specially ordered male threads, and thus it is possible to save cost by not requiring a specially ordered item.

Figure 38:
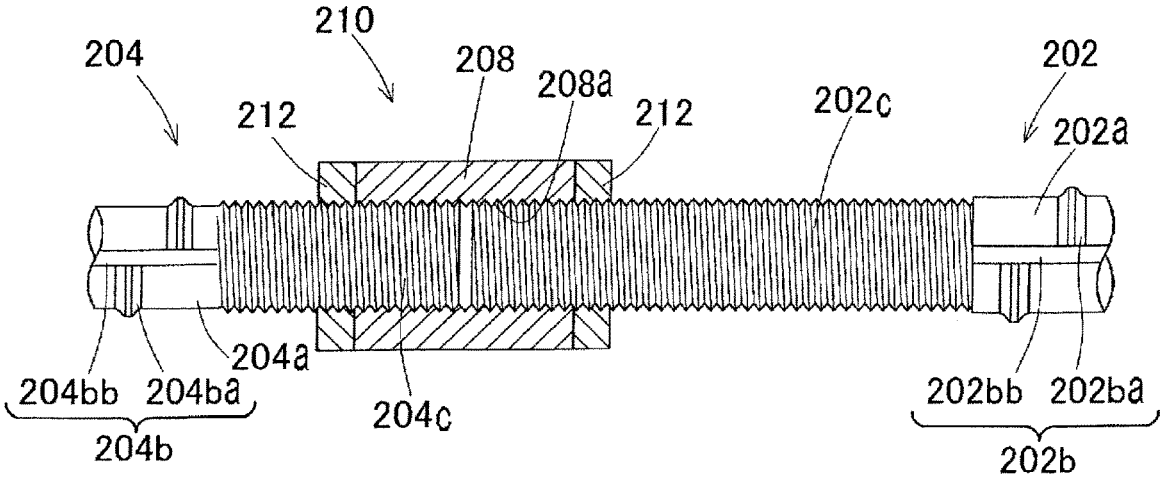
FIG. 38 is a sectional view of use example of lock nuts in the threaded reinforcing bar coupling structure.

As shown in FIG. 38, the threaded reinforcing bar coupling structure 210 may have lock nuts 212 screwed onto the male threaded portions 202*c*, 204*c* on both sides of the coupler 208. When the coupling structure has the lock nuts 212, it is possible to transmit compression force acting on the reinforcing bars 202, 204.

Figure 39:
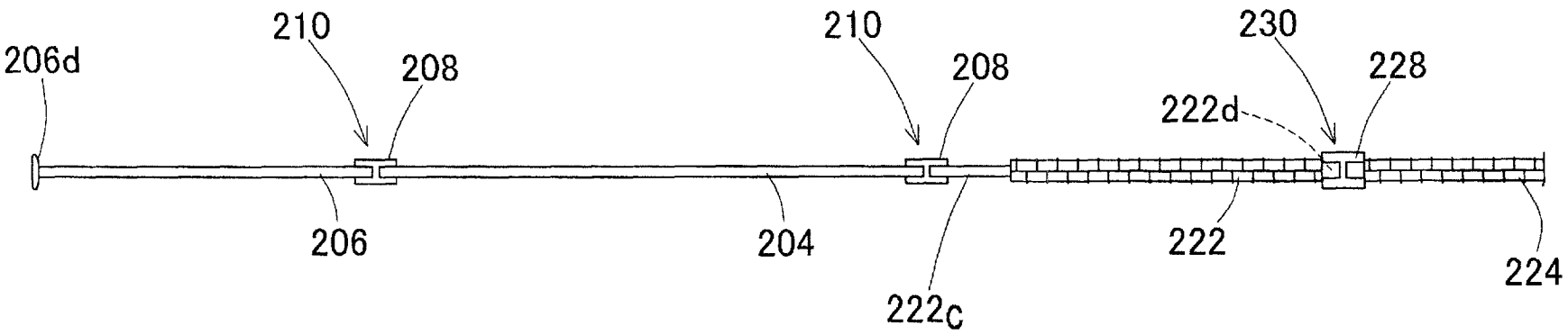
FIG. 39 is a schematic cutaway front view of a bar arrangement structure in which a threaded reinforcing bar coupling structure according to an eleventh embodiment of the present invention is used.
Figure 40:
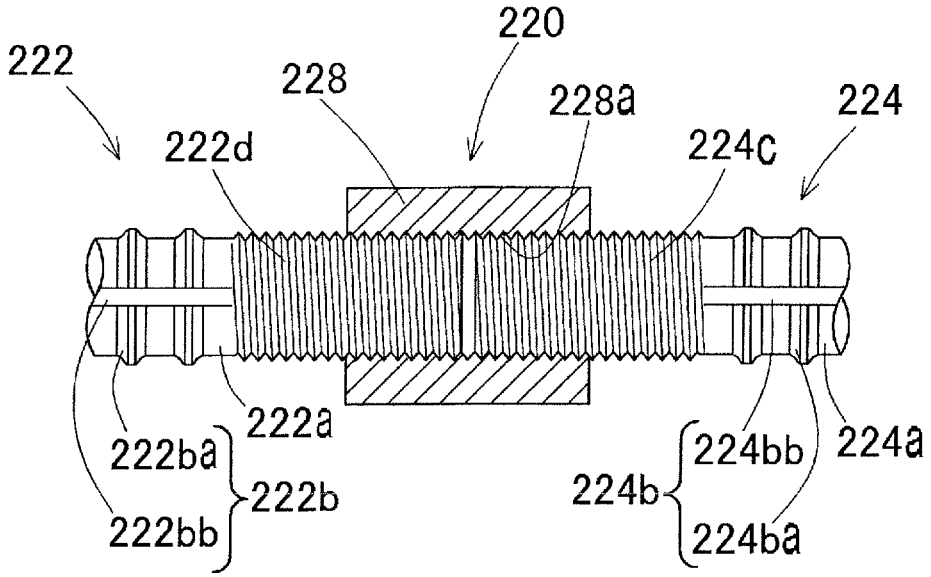
FIG. 40 is a sectional view of a threaded reinforcing bar coupling structure on a large diameter side in the bar arrangement structure.

FIGS. 39 and 40 show an eleventh embodiment of the present invention. The eleventh embodiment is the same as the tenth embodiment described above except for matters specifically described. In the eleventh embodiment, a length adjusting reinforcing bar 222 has an elongated male threaded portion 222*c* only on one end thereof and a male threaded portion 222*d* having a certain length formed on the other end thereof. The portion of the reinforcing bar main body 222*a* in the elongated male threaded portion 222*c* of the length adjusting reinforcing bar 222 is left unprocessed. The male threaded portion 222*d* having a certain length has a thread groove diameter one rank higher than those of the standard length reinforcing bars 204, 206 to be connected to the side of the elongated male threaded portion 222*c*. For example, when the standard length reinforcing bars 204, 206 are of D22, the length adjusting reinforcing bar 222 is of D25.

The standard length reinforcing bar 224 that is connected to the side of the male threaded portion 222*d* having a certain length of the length adjusting reinforcing bar 222 has the same diameter as that of the length adjusting reinforcing bar 222. For example, when the length adjusting reinforcing bar 222 is of D25, the standard length reinforcing bar 224 is also a deformed reinforcing bar of D25. Therefore, in the threaded reinforcing bar coupling structure 230 that connects the standard length reinforcing bar 224 on the large diameter side and the length adjusting reinforcing bar 222, the thread diameters of the male threaded portions 222*d*, 224*c* and the female thread portion 228*a* of the coupler 228 are set to be larger than the diameter of the elongated male threaded portion 222*c* that connects the standard length reinforcing bars 204, 206 on the small diameter side (FIG. 39). The elongated male threaded portion 222*c* of the length adjusting reinforcing bar 222 has the same diameter as that of the middle standard length reinforcing bar 204.

Also in the present embodiment, projections 222*b*, 224*b* are formed on the outer peripheries of the reinforcing bar main bodies 222*a*, 224*a* of the length adjusting reinforcing bar 222 and the standard length reinforcing bar 224 on the large diameter side, respectively. The projections 222*b*, 224*b* include node portions 222*ba*, 224*ba* and ribs 222*bb*, 224*bb*, respectively.

This configuration is also advantageous as the tenth embodiment in that it is possible to easily adjust a length at an operation site of bar arrangement, thus to simplify the manufacturing process and to save costs.

Figure 41:
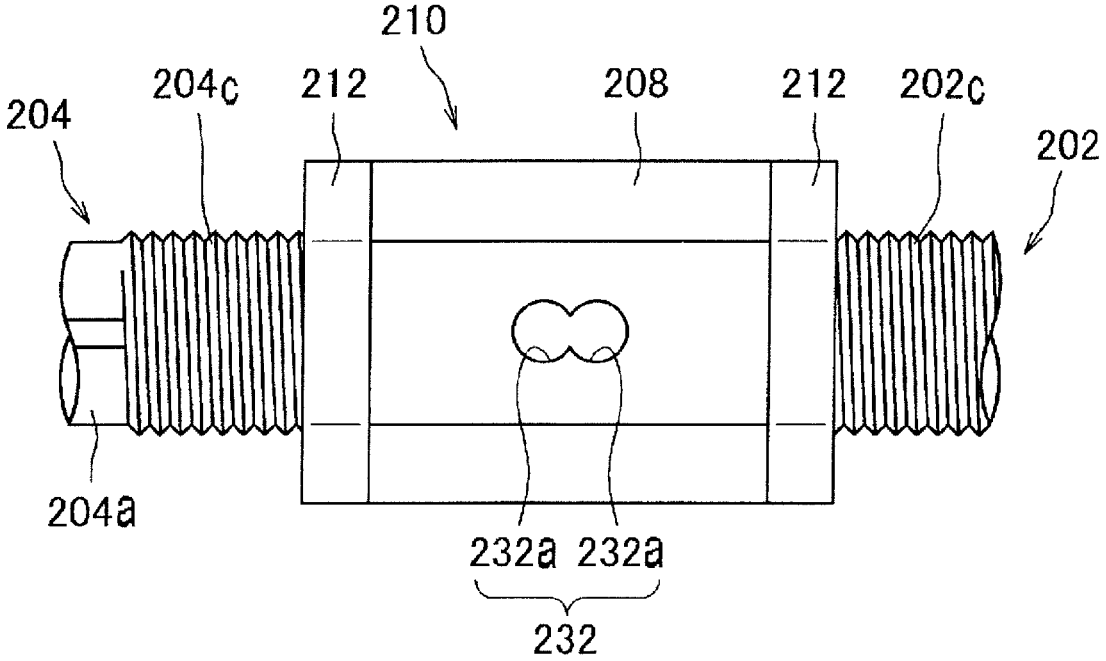
FIG. 41 is a front view of a threaded reinforcing bar coupling structure according to a twelfth embodiment of the present invention.
Figure 42A:
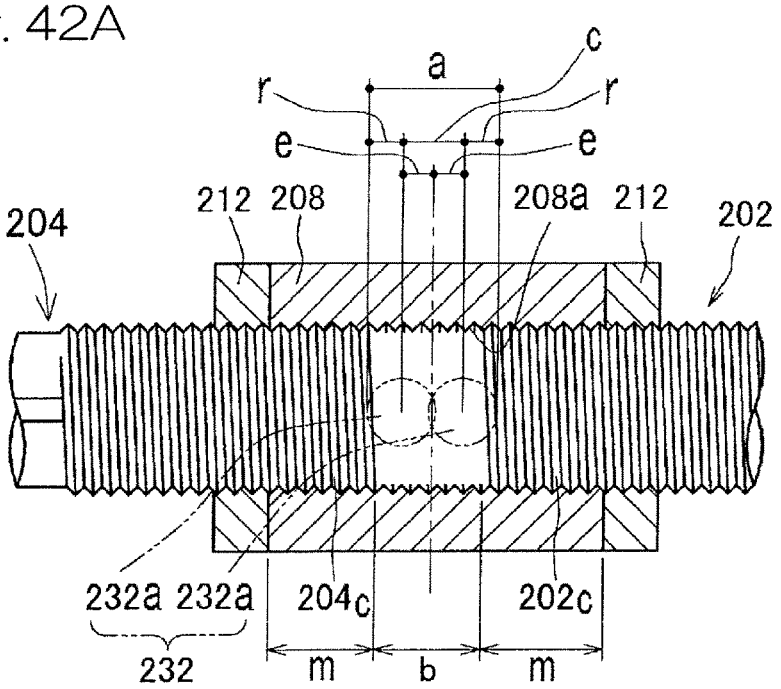
FIG. 42A is a longitudinal sectional view of the threaded reinforcing bar coupling structure.
Figure 42B:
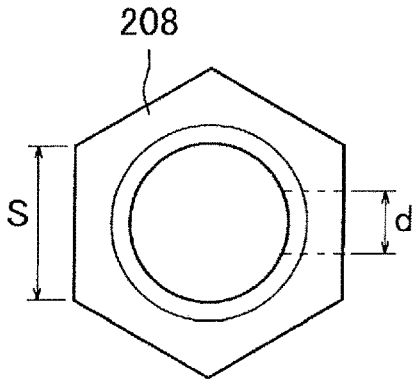
FIG. 42B is a side view of a coupler of the threaded reinforcing bar coupling structure.
Figure 43:
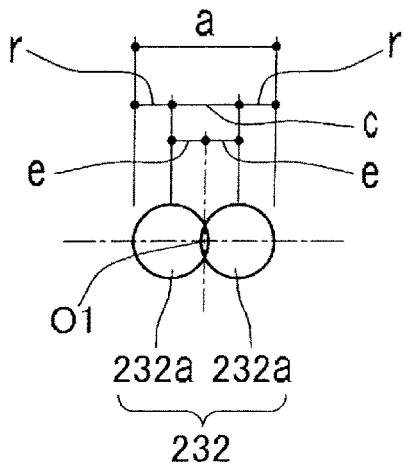
FIG. 43 illustrates dimensions of a fastening length confirmation hole of the coupler.

FIGS. 41 to 43 shows a twelfth embodiment of the present invention. The threaded reinforcing bar coupling structure in the twelfth embodiment differs from the threaded reinforcing bar coupling structure according to the tenth embodiment described above, in that a confirmation hole 232 is provided for confirming a fastening length in the coupler 208. The twelfth embodiment is the same as the tenth embodiment except for matters specifically described. In FIG. 41, the threaded reinforcing bar coupling structure 210 of the twelfth embodiment is used between the length adjusting reinforcing bar 202 and the middle standard length reinforcing bar 204. However, the threaded reinforcing bar coupling structure 210 of the twelfth embodiment can be used at any location of the bar arrangement structure in FIG. 33.

In the twelfth embodiment, a confirmation hole 232 for a fastening length is provided at a center in the length direction of the coupler 208. The confirmation hole 232 of the present embodiment has a shape in which two round hole portions 232*a*, 232*a* arranged in the axial direction are continued to form a single hole. A length a of the confirmation hole 232 for the fastening length in a coupler longitudinal direction is set to be slightly longer than a distance b between inner surfaces of the reinforcing bars 202, 204 in a state where the male threaded portion 202*c*, 204*c* of the reinforcing bars 202, 204 are screwed into the coupler 208 by a predetermined minimum fastening length m (a>b). The extent of being set to be longer (difference between the length a and the distance b) is a minimum distance that the end portion of the outer peripheral surface of the reinforcing bar 202 can be seem when viewed from the outside of the confirmation hole 232. FIG. 43 shows dimensions relating the confirmation hole 232.

An example of the dimensions is described. When the reinforcing bars 202, 204 for D16 or D19 has a distance b between inner surfaces of the reinforcing bars 202, 204 of 10 mm, the length a of the confirmation hole 232 in the coupler longitudinal direction is 11 mm. Therefore, the length a is longer than the distance b by 0.5 mm on each side. The two hole portions 232*a*, 232*a* has a diameter d of 6 mm (a radius r of 3 mm), and a distance c between the centers of the hole portions 232*a*, 232*a* is 5 mm. Therefore, a distance e between the center of each of the hole portions 232*a*, 232*a* and the center O1 of the confirmation hole 232 in the coupler longitudinal direction is 2.5 mm. When reinforcing bars 202, 204 of D22 to 29 are used, the respective dimensions may be, for example, a=12 mm, c=5 mm, r=3.5 mm.

In this configuration, when one reinforcing bar of the pair of reinforcing bars 202, 204 is not screwed into the coupler 208 to the minimum fastening length m, the edge of the outer peripheral surface of the one reinforcing bar 202 (204) is not seen when viewed through the confirmation hole 232 for the fastening length. When both reinforcing bars 202, 204 are screwed to the minimum fastening length m, the edges of the outer peripheral surfaces of both reinforcing bars 202, 204 are seen through the confirmation hole 232. Therefore, it is possible to confirm whether or not they are screwed to the minimum fastening length m through the confirmation hole 232. By making it possible to confirm fastening in this way, it can be expected to achieve A class couplings in a standard of reinforcing bar couplings (certified by Japan Reinforcing Bar Joints Institute). It should be noted that the end surfaces of the reinforcing bars 202, 204 may be in contact with each other inside the confirmation hole 232 for the fastening length.

Additionally, in the twelfth embodiment, since the confirmation hole 232 has a shape that the two round hole portions 232*a*, 232*a* are continued to form a single hole, the dimension of the confirmation hole 232 in the circumferential direction of the coupler 208 can be made small. As a result, it is advantageous in strength because decrease in the cross-sectional area of the coupler 208 due to formation of the confirmation hole 232 is small. Also, the confirmation hole 232 for the fastening length may be shaped in a single ellipse having its long axis in the longitudinal direction of the coupler 208, but the confirmation hole can be easily formed by making two round hole portions 232*a*, 232*a* when the shape of the twelfth embodiment is used.

Figure 44:
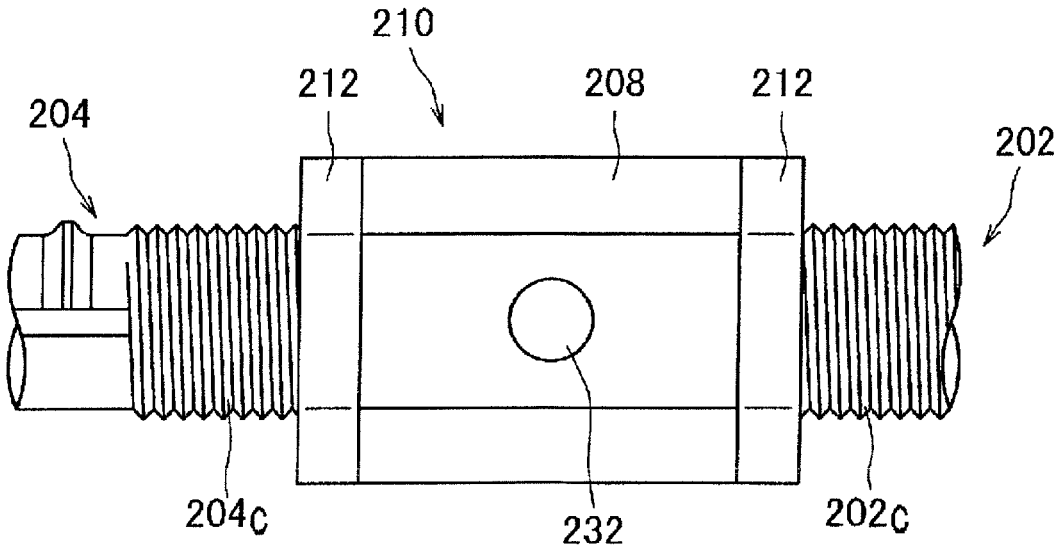
FIG. 44 is a front view of a variant of the threaded reinforcing bar coupling structure.

Other than these shapes, the confirmation hole 232 may be shaped to be round as shown in FIG. 44. However, in that case, it is preferable to set the diameter of the confirmation hole 232 to be 45% at most of a length S of a side of a hexagonal coupler 208 (FIG. 42B). In the case where it is made larger than that, loss in the cross-sectional area may exceed an acceptable value. It is preferable to ensure that the cross-sectional area of the coupler 208 is about 120% of the cross-sectional areas of the reinforcing bars 202, 204 even after formation of the confirmation hole 11.

Figure 45:
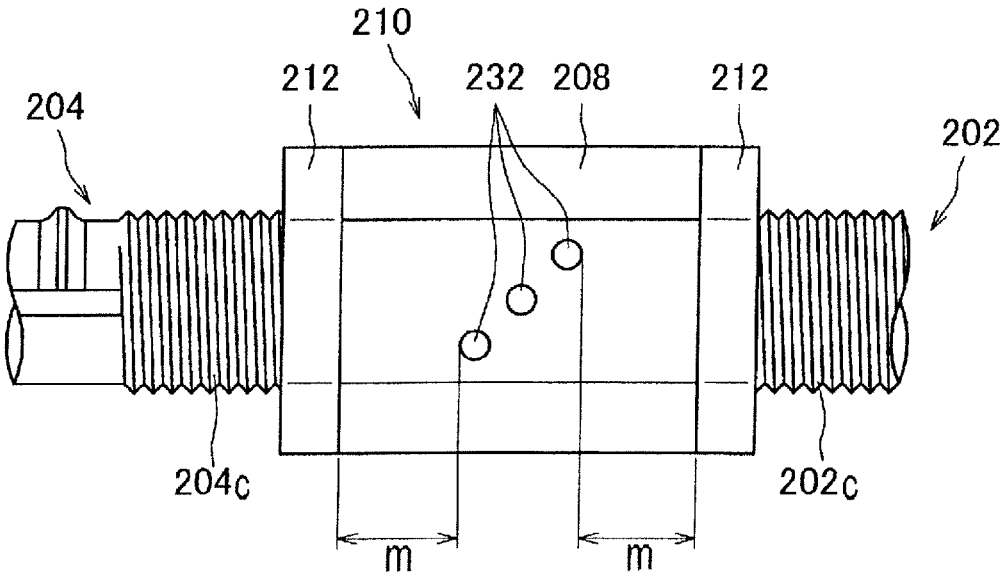
FIG. 45 is a front view of another variant of the threaded reinforcing bar coupling structure.
Figure 46:
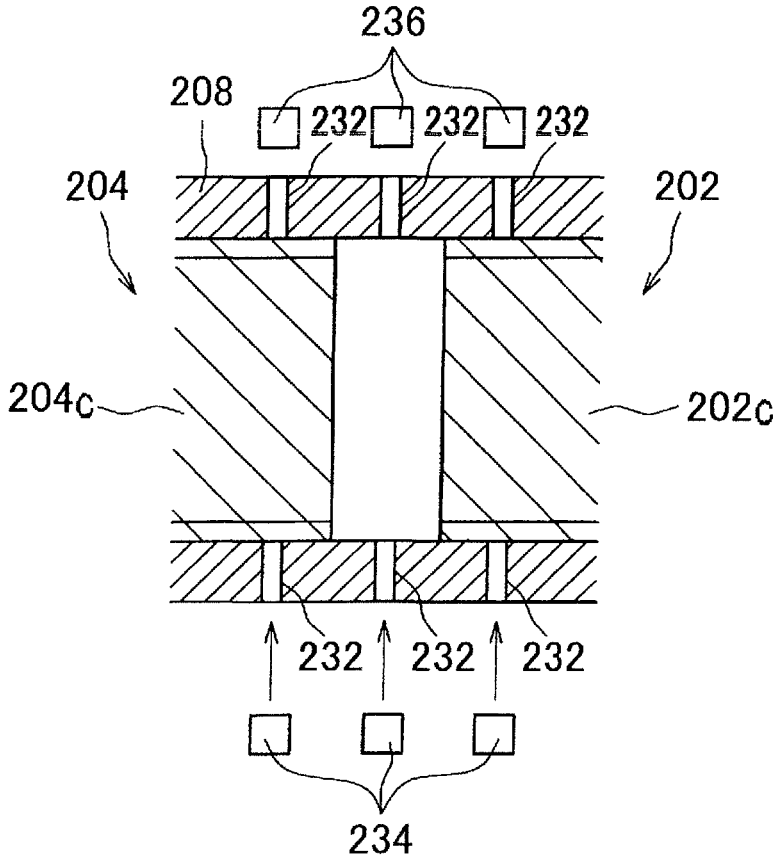
FIG. 46 illustrates use of the threaded reinforcing bar coupling structure.

FIGS. 45 and 46 show another example of the confirmation hole 232. This example is the same as the tenth embodiment except for matters specifically described. In this example, three confirmation holes 232 having a smaller diameter than that of the hole in the example in FIG. 41 are provided on one surface so as to be spaced apart in the length direction of the coupler 208. The three confirmation holes 232 may be spaced apart in the circumferential direction of the coupler 208 as in FIG. 45 or may be disposed in the same circumferential position. The confirmation hole 232 in the middle is disposed at the center of the coupler 208 in the longitudinal direction, and the confirmation hole 232 on both sides are disposed in the locations apart by the minimum fastening length m from end portions of the coupler 208. Three confirmation hole 232 are further provided on the back surface of the coupler 208, and the total number of the holes is six. The confirmation hole 232 on the front side and the corresponding confirmation hole 232 on the back side are disposed in the same axial positions and apart from each other by 180° in the circumferential direction.

In the case of this variant, for example, as shown in FIG. 46, confirmation is performed by using a transmission type photoelectric sensor including a light emitting element 234 and a light receiving element 236 and passing light through a confirmation hole 232. It is confirmed that reinforcing bars are screwed by a minimum fastening length m when light passes through a confirmation hole 232 in the middle and is blocked in confirmation holes 232 on both sides. Instead of a photoelectric sensor, confirmation can similarly be performed by inserting a pin-shaped confirmation jig into a confirmation hole 232. In the case of this variant, confirmation requires a tool but allows a confirmation hole 232 to have a smaller diameter, thus decrease in the cross-sectional area of a coupler 208 can be suppressed.

The present invention is not limited to the embodiments described above, and various additions, modifications, or deletions may be made without departing from the gist of the invention. For example, the confirmation hole 232 in FIGS. 41 to 46 may be provided in the first to ninth embodiments. Therefore, the present invention also includes such configuration.

The embodiments and variants shown in FIGS. 33 to 46 include following aspects 1 to 5.

[Aspect 1]

A bar arrangement structure as set forth in aspect 1, in which reinforcing bars that are a plurality of deformed reinforcing bars arranged in a length direction thereof are connected by a threaded reinforcing bar coupling structure comprising a screw tubular coupler having a female thread portion on an inner periphery thereof and male threaded portions provided on end portions of the adjacent reinforcing bars so as to be screwed into the coupler, wherein:

a part of the plurality of reinforcing bars is a length adjusting reinforcing bar, and a remaining part of the plurality of reinforcing bars is a standard length reinforcing bar;

the male threaded portion of the standard length reinforcing bar is formed in a certain length for use in the threaded reinforcing bar coupling; and the length adjusting reinforcing bar has an elongated male threaded portion for length adjustment to be formed into the male threaded portion, the length adjustment male threaded portion being cut into any length and used for connection to the coupler.

[Aspect 2]

The bar arrangement structure according to aspect 1, wherein a confirmation hole for confirming that the reinforcing bars on both sides are screwed into the coupler to a predetermined minimum fastening length is formed in an intermediate location in the length direction of the coupler.

[Aspect 3]

A reinforcing bar comprising a deformed reinforcing bar having an elongated male threaded portion for length adjustment to be cut into any length and used, wherein a male threaded portion that is formed by cutting the elongated male threaded portion has a length that allows the male threaded portion to be connected to a screw tubular coupler having a female thread portion on an inner periphery thereof to constitute a threaded reinforcing bar coupling.

[Aspect 4]

A method for constructing a bar arrangement comprising: preparing: a plurality of standard length reinforcing bars, each standard length reinforcing bar having a male threaded portion having a certain length on an end portion thereof; a length adjusting reinforcing bar having a long male threaded portion for length adjustment to be cut into any length and used on an end portion thereof; and a plurality of screw tubular couplers, each screw tubular coupler having a female thread portion on an inner periphery thereof, wherein the standard length reinforcing bars and the length adjusting reinforcing bar are deformed reinforcing bars;

cutting the elongated male threaded portion of the length adjusting reinforcing bar to adjust a length of an entire bar arrangement in which the standard length reinforcing bars and the length adjusting reinforcing bar are arranged in a length direction to an entire length of one bar arrangement; and connecting the adjacent reinforcing bars with each other by using the couplers.

REFERENCE NUMERALS

1, 1A, 102 reinforcing bar
1*a*, 106 reinforcing bar main body
1*b* projection
1*ba*, 108 node portion
1*bb* rib
1*c*, 112 male threaded portion
2, 104 coupler
2*a* female thread portion
3, 120 lock nut
4, 110 strip-shaped flat portion
D1 outer diameter of a reinforcing bar main body
D2 maximum diameter
D30 thread effective diameter
D31 thread groove diameter
D32, D32' thread ridge diameter
S1 cutting step
S2 perfect circle processing step
S3 male thread rolling step

What is claimed is:

1. A threaded reinforcing bar coupling structure for a deformed reinforcing bar, the structure comprising a pair of reinforcing bars and a screw tubular coupler connecting the pair of reinforcing bars with each other, wherein:

at least one reinforcing bar of the pair of reinforcing bars is a deformed reinforcing bar including a reinforcing bar main body having a round shaft shape and a plurality of annular node portions on an outer periphery of the reinforcing bar main body provided so as to be spaced apart in a longitudinal direction of the reinforcing bar and a projection extending in the longitudinal direction;

each reinforcing bar has opposite end portions, at least one of the opposite end portions having a cylindrical portion with the node portions removed, the cylindrical portion being formed with a male threaded portion;

the male threaded portion has a thread groove diameter smaller than that of the reinforcing bar main body and has thick portions having a large thread ridge diameter in multiple locations in width regions corresponding to the node portions and thin portions having a small ridge diameter in remaining portions of the male threaded portion except for the same circumferential position as the protection;

the thread groove diameters of both of the thick portions and the thin portions are mutually the same, and a thread groove depth of the thin portions is 70% or higher of a thread groove depth of the thick portions;

the thread ridge diameter of the thick portions is larger than a diameter of the reinforcing bar main body of the reinforcing bar and smaller than a maximum diameter including the protection;

the male threaded portion has hardness or tensile strength greater than that of a remaining portion of the reinforcing bar; and the coupler is screwed onto the male threaded portions of the pair of reinforcing bars.

2. The threaded reinforcing bar coupling structure for a deformed reinforcing bar as claimed in claim 1, wherein at least one reinforcing bar of the pair of reinforcing bars includes spiral node portions.

3. The threaded reinforcing bar coupling structure for a deformed reinforcing bar as claimed in claim 2, wherein strip-shaped flat portions are formed at two locations apart from each other by 180° on the outer peripheral surface of the at least one of the pair of reinforcing bars so as to be straight lines in a cross section perpendicular to an axial direction of the reinforcing bar, and each strip-shaped flat portion is constituted of a straight line as a part of an arc of a circle forming the outer peripheral surface of the reinforcing bar main body and is formed over an entire length of the reinforcing bar main body in the axial direction.

4. The threaded reinforcing bar coupling structure for a deformed reinforcing bar as claimed in claim 1, further comprising a lock nut that is screwed onto the male threaded portion of the reinforcing bar and abuts with an end surface of the coupler.

5. A bar arrangement structure in which reinforcing bars that are a plurality of deformed reinforcing bars arranged in a length direction thereof are connected with each other by the threaded reinforcing bar coupling structure as claimed in claim 1, wherein:

a part of the plurality of reinforcing bars is a length adjusting reinforcing bar, and a remaining part of the plurality of reinforcing bars is a standard length reinforcing bar;

the male threaded portion of the standard length reinforcing bar is formed in a certain length for use in a threaded reinforcing bar coupling; and the male threaded portion of the length adjusting reinforcing bar is formed longer than the male threaded portion of the standard length reinforcing bar.

6. The bar arrangement structure as claimed in claim 5, wherein a confirmation hole for confirming that the pair of reinforcing bars are screwed into the coupler to a predetermined minimum fastening length is formed in an intermediate location in a length direction of the coupler.

7. A threaded reinforcing bar coupling structure for a deformed reinforcing bar, the structure comprising a pair of reinforcing bars and a screw tubular coupler connecting the pair of reinforcing bars with each other, wherein:

at least one reinforcing bar of the pair of reinforcing bars is a deformed reinforcing bar including a reinforcing bar main body having a round shaft shape and a plurality of annular node portions on an outer periphery of the reinforcing bar main body provided so as to be spaced apart in a longitudinal direction of the reinforcing bar;

each reinforcing bar has opposite end portions, at least one of the opposite end portions having a cylindrical portion with the node portions removed, the cylindrical portion being formed with a male threaded portion;

the male threaded portion has a thread groove diameter smaller than that of the reinforcing bar main body and has thick portions having a large thread ridge diameter in multiple locations in width regions corresponding to the node portions and thin portions having a small thread ridge diameter in remaining portions of the male threaded portion;

the thread groove diameters of both of the thick portions and the thin portions are mutually the same, and a thread groove depth of the thin portions is 70% or higher of a thread groove depth of the thick portions;

the thread ridge diameter of the thick portions is larger than a diameter of the reinforcing bar main body of the reinforcing bar and smaller than a maximum diameter including the node portions;

the male threaded portion has hardness or tensile strength greater than that of a remaining portion of the reinforcing bar; and the coupler is screwed onto the mail threaded portions of the pair of reinforcing bars.

8. The threaded reinforcing bar coupling structure for a deformed reinforcing bar as claimed in claim 7, wherein strip-shaped flat portions are formed at two locations apart from each other by 180° on the outer peripheral surface of the at least one of the pair of reinforcing bars so as to be straight lines in the cross section perpendicular to an axial direction of the reinforcing bar; and each strip-shaped flat portion is constituted of a straight line as a part of an arc of a circle forming the outer peripheral surface of the reinforcing bar main body and is formed over the entire length of the reinforcing bar main body in the axial direction.

* * * * *